US005765410A

United States Patent [19]

Kwan et al.

[11] Patent Number: 5,765,410

[45] Date of Patent: Jun. 16, 1998

[54] LOCKS

[75] Inventors: Ka-Chin Kwan, Brighouse; Colin Middleton, Bootle, both of Great Britain

[73] Assignees: European Lock Company Limited, Merseyside; WMS (UK) Limited, West Yorkshire, both of England

[21] Appl. No.: 569,220

[22] PCT Filed: Jun. 27, 1994

[86] PCT No.: PCT/GB94/01387

§ 371 Date: Mar. 25, 1996

§ 102(e) Date: Mar. 25, 1996

[87] PCT Pub. No.: WO95/01491

PCT Pub. Date: Jan. 12, 1995

[30] Foreign Application Priority Data

| | | | |
|---|---|---|---|
| Jun. 29, 1993 | [GB] | United Kingdom | 9313364 |
| Feb. 8, 1994 | [GB] | United Kingdom | 9402358 |
| Feb. 14, 1994 | [GB] | United Kingdom | 9402786 |

[51] Int. Cl.[6] ..... E05B 59/00

[52] U.S. Cl. ..... 70/107; 70/134; 292/36

[58] Field of Search ..... 70/107, 129, 134; 292/36, 35, 139

[56] References Cited

U.S. PATENT DOCUMENTS

| | | | |
|---|---|---|---|
| 2,380,708 | 7/1945 | Schlage et al. | 70/129 |
| 3,175,376 | 3/1965 | Cantwell | 70/131 |
| 4,606,203 | 8/1986 | Esser | 70/107 |
| 4,688,406 | 8/1987 | Horgan, Jr. | 292/139 |
| 5,265,920 | 11/1993 | Kaup et al. | 70/107 |
| 5,301,525 | 4/1994 | Döring | 70/107 |

FOREIGN PATENT DOCUMENTS

| | | | |
|---|---|---|---|
| 259763 | 5/1913 | Austria | 70/134 |
| 0 376 572A3 | 3/1991 | European Pat. Off. | E05B 63/04 |
| 0 516 928A1 | 3/1992 | European Pat. Off. | E05B 59/00 |
| 2239894 | 2/1975 | France | E05B 3/00 |
| 182185 | 4/1906 | Germany | 70/129 |
| 1033082 | 7/1958 | Germany | 70/134 |
| 2504410 | 8/1976 | Germany | 70/134 |
| 2527341 | 12/1976 | Germany | 70/134 |
| 2533977A1 | 2/1977 | Germany | E05B 65/02 |
| 3400618A1 | 7/1985 | Germany | E05B 65/02 |
| 3736592A1 | 5/1989 | Germany | E05B 65/10 |
| 2036162 | 6/1980 | United Kingdom | 70/134 |

*Primary Examiner*—Darnell M. Boucher
*Attorney, Agent, or Firm*—Madson & Metcalf

[57] ABSTRACT

A lock for a door or the like having a dead lock assembly which comprises a bolt (41) and a drive mechanism (53, 54) adapted to be operated by a key, wherein the drive mechanism comprises a driving link (46), arranged to be driven by a lever (54) actuated by the key and arranged in turn to drive the bolt, and means (56) for transferring the drive from the driving link (46) to the bolt (41) in such a manner that the movement or throw of the bolt is increased relative to the displacement of the driving link (46).

23 Claims, 18 Drawing Sheets

LOCKS

This invention relates to improvements in locks and is particularly concerned with means for increasing the throw or movement of the bolt of a mortise lock.

The maximum longitudinal movement or "throw" of the bolt of a mortise lock is limited by the width of the lock casing. Where a lock is to be installed in a solid wooden door, for example, the width of the casing is relatively unimportant because there is no restriction on the depth of the recess in the door which is to accommodate the lock casing. However, in the case of a predominately glass door with a surrounding frame of wood or plastics material, the maximum width of the lock casing must be less than the width of the door frame. Typically, the frames of such doors have a width in the region of 50 mm. and the overall width of lock casings which can be installed in such door frames is of the order of 40 mm.

In order to be fitted in such a door frame, the maximum distance from the outside front of the casing to the axis of a cylinder for the lock, is of the order of 28 mm. Such a lock is known as narrow style and the distance from the outside front of the lock casing to the said cylinder axis is commonly referred to as the backset. When such a latch is fitted with a deadbolt, the bolt is conventionally arranged to be driven by a cylinder cam and, with a backset of only 28 mm, the maximum bolt projection, i.e. the distance by which the bolt projects from the front of the casing when the bolt is thrown, that can normally be obtained by direct drive from a cylinder cam is of the order of only 14 mm. This distance is insufficient to provide a secure locking engagement in the framework surrounding the door.

This problem becomes increasingly acute with the use of new materials such as UPVC in which there is a substantial gap between the edge of the door and the surrounding frame. In order to meet the new EEC standard, a throw of 20 mm is required so that the head of the deadbolt projects into a striking plate in the frame for a distance which is sufficient to make the door secure.

The existing narrow style latches have been unable to achieve a deadbolt throw of the order of 20 mm. and the present invention aims to provide a mortise lock with an increased bolt projection or throw for a given width of lock casing.

According to one aspect of the invention, there is provided a lock for a door or the like having a dead lock assembly which comprises a bolt and a drive mechanism adapted to be operated by a key, wherein the drive mechanism comprises a driving link, arranged to be driven by a lever actuated by the key and arranged in turn to drive the bolt, and means for transferring the drive from the driving link to the bolt in such a manner that the movement or throw of the bolt is increased relative to the displacement of the driving link.

The driving link is desirably sandwiched between the bolt and the drive transferring means.

Preferably, the means for transferring the drive to the deadbolt comprise a quadrant having a peg which engages through a slot in the driving link and into a slot in the bolt.

The quadrant is desirably pivotally connected to the driving link and is provided with guide means for guiding its pivotal movement in the casing.

The driving link is preferably provided with guide means for ensuring that said link moves only in a longitudinal direction substantially parallel to the movements of the bolt.

The lock according to the invention desirably includes a spring-loaded detainer and means for providing an engagement between the detainer and the bolt, the detainer being urged by the spring to a position in which the engagement means are effective to immobilise the bolt in its thrown or locking position. Preferably, the engagement means comprise a detainer pin on the bolt which is engageable in a slot in the detainer, the slot having such a configuration that the pin is retained in a fixed position in the slot by the spring when the bolt is in the thrown or locked position.

The lock according to the invention preferably also includes a cylinder having a cam arranged to be turned by a key, the cam being engageable with the detainer to move the latter, against the action of the spring, to a position in which the detainer pin on the bolt is free to move in the slot in the detainer.

According to a preferred embodiment, the lock according to the invention includes a casing accommodating the said deadbolt assembly and a pair of additional deadbolts slidably mounted in the casing, said pair of additional deadbolts being arranged to be operated simultaneously by drive means and said drive means being arranged to be immobilised when the deadbolt of said first mentioned deadbolt assembly is in the thrown or locked position.

Preferably, the drive means for the additional deadbolts is arranged to prevent the deadbolt of the first mentioned deadbolt assembly from being moved from the withdrawn to the thrown position unless said drive means has been operated to move the additional deadbolts to the thrown or locked position.

The lock according to the invention preferably also includes a latch mechanism adapted to be operated by one or more door handles.

Another problem encountered with existing locks is that of preventing unauthorised entry into premises which are occupied when the door is fitted with a latch which can be operated by a handle. This problem can be overcome by locking the door on the inside but this is inconvenient and, with conventional arrangements, involves the use of a key.

The present invention also seeks to solve this problem by providing a lock which can be dead locked from either side of a door fitted with the lock, without the use of a key, but which can be unlatched from one side of the door again without the use of a key, the key being required to unlatch the door from its other side.

Accordingly, another aspect of the invention comprises a lock having two drive shafts, a first one of the drive shafts being adapted to be fitted with a first handle on one side of a door and the second of the drive shafts being adapted to be fitted with a second handle on the other side of the door, the first handle being arranged to operate both the drive means for the additional deadbolts as well as a latch mechanism and the second handle being arranged to operate only the drive means for the additional deadbolts.

If the second handle is fitted on the outside of the door, the door cannot be opened from the outside by means of the handle. However, the lock preferably includes a linkage whereby the latch mechanism can be operated by means of a key engaging in the lock from the outside of the door in order that the door can be opened.

With this arrangement, the door can be opened or locked from the inside, without the use of a key, merely by turning the first door handle in an appropriate direction.

The two drive shafts are desirably provided with intermeshing pinions whereby movement of one of the drive shafts to lock or unlock the additional deadbolts is transferred to the other drive shaft. Means are further provided to permit the first drive shaft to be turned to operate the latch mechanism without said turning movement being transmitted to the second drive shaft.

The invention will now be further described, by way of example, with reference to the drawings, in which.

Figure 16B:
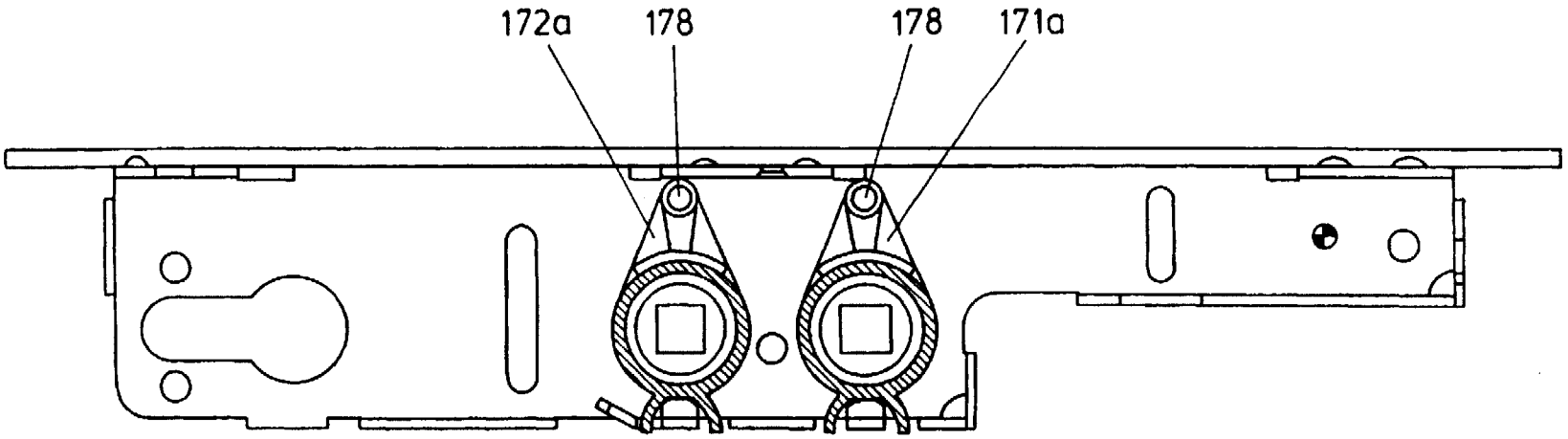
Figure 16A:
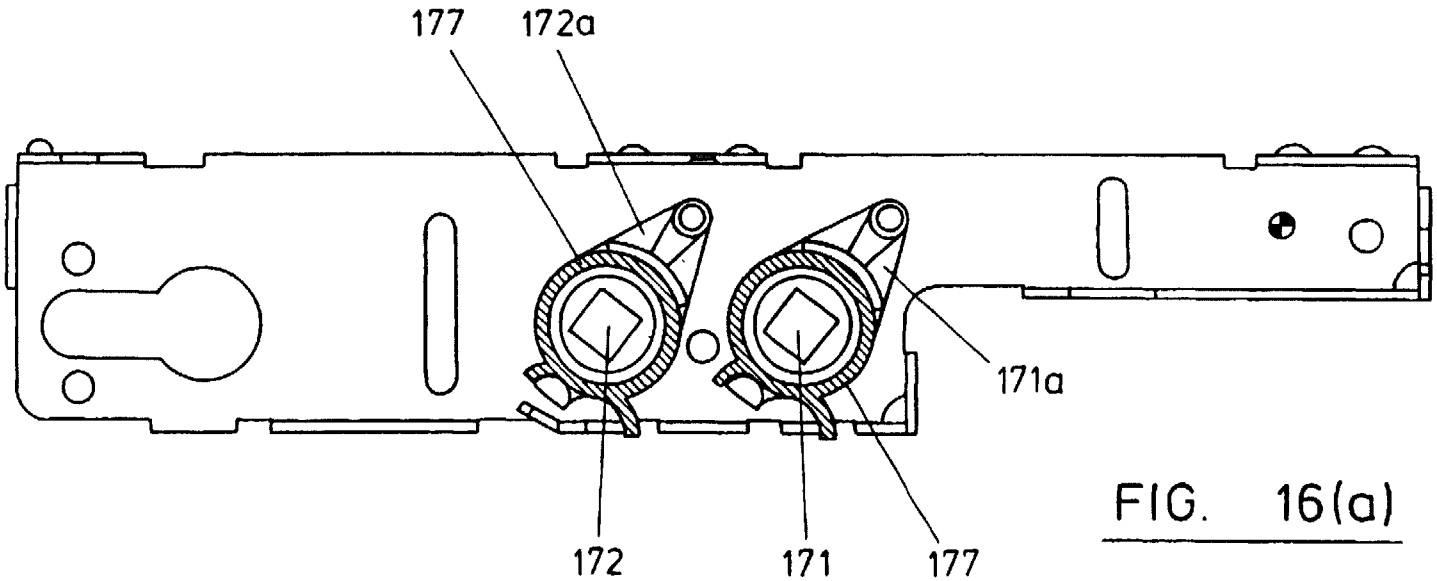
Figure 17E:
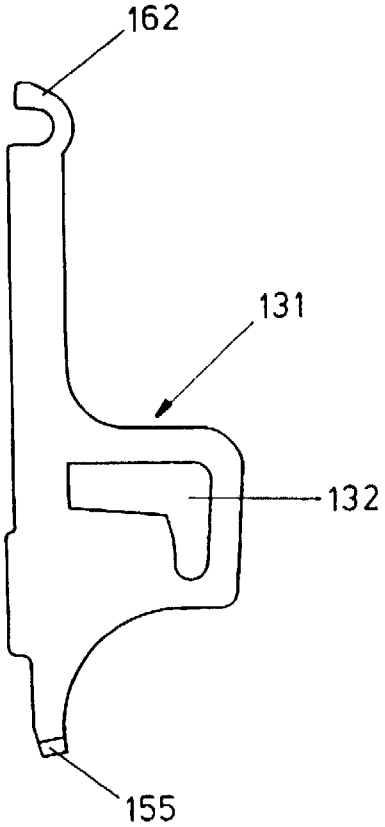
Figure 17D:
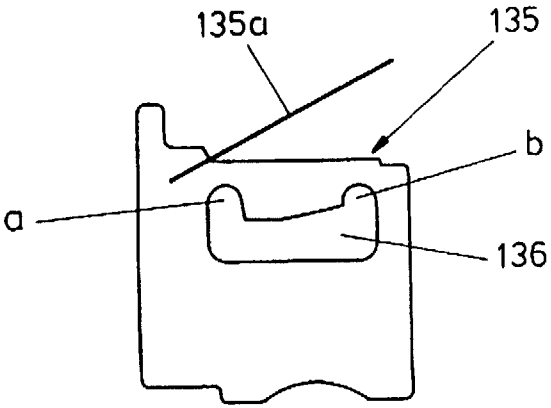
Figure 17C:
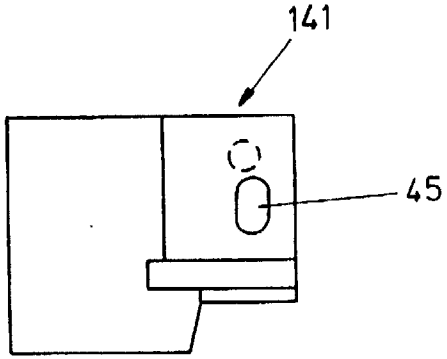
Figure 17A:
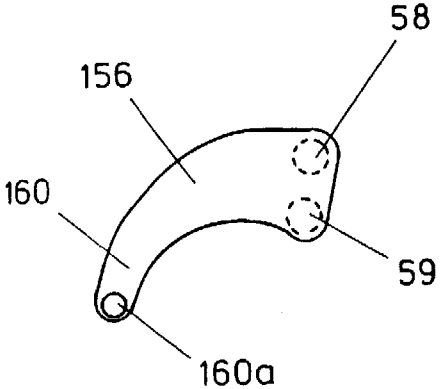
Figure 17B:
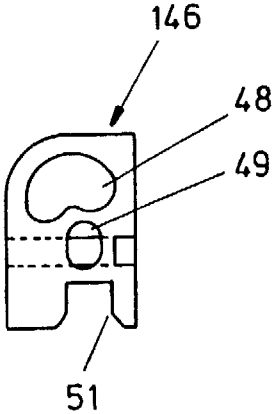
Figure 18B:
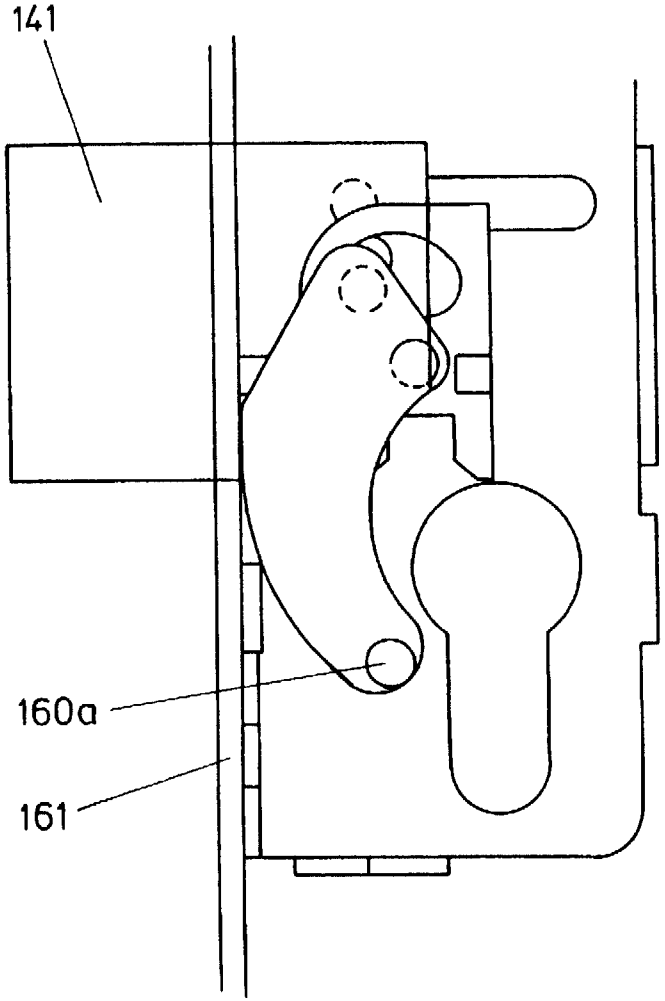
Figure 18A:
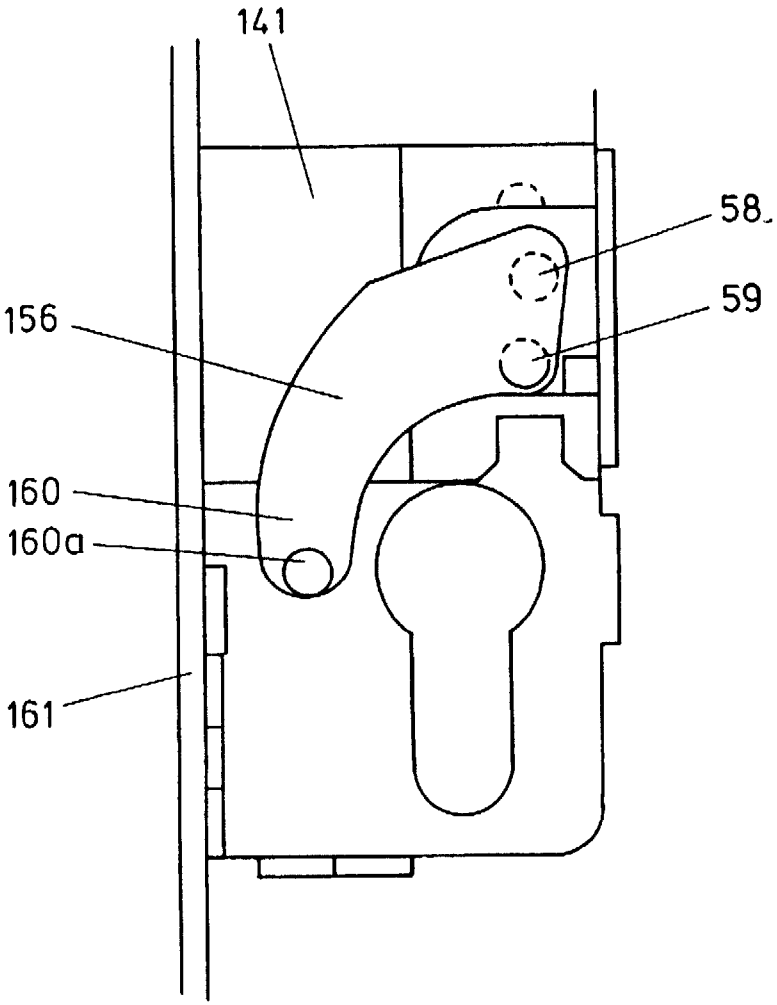
Figure 18D:
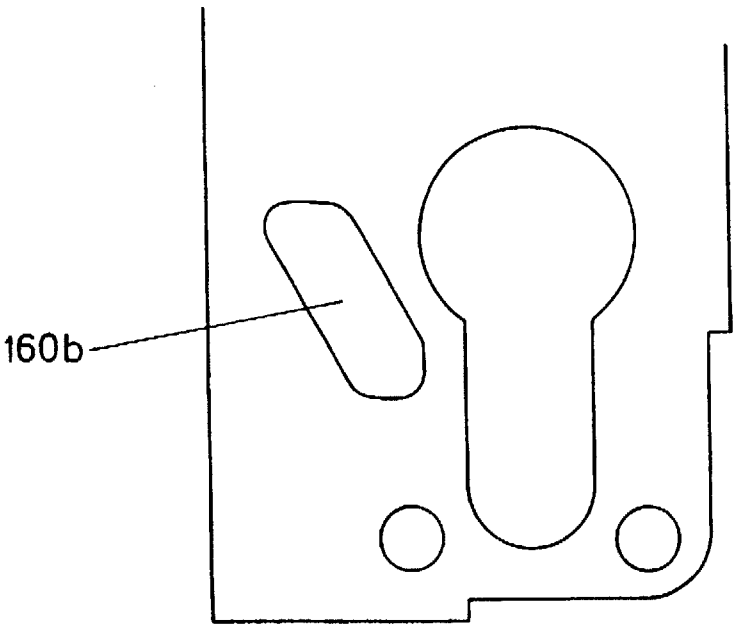
Figure 18C:
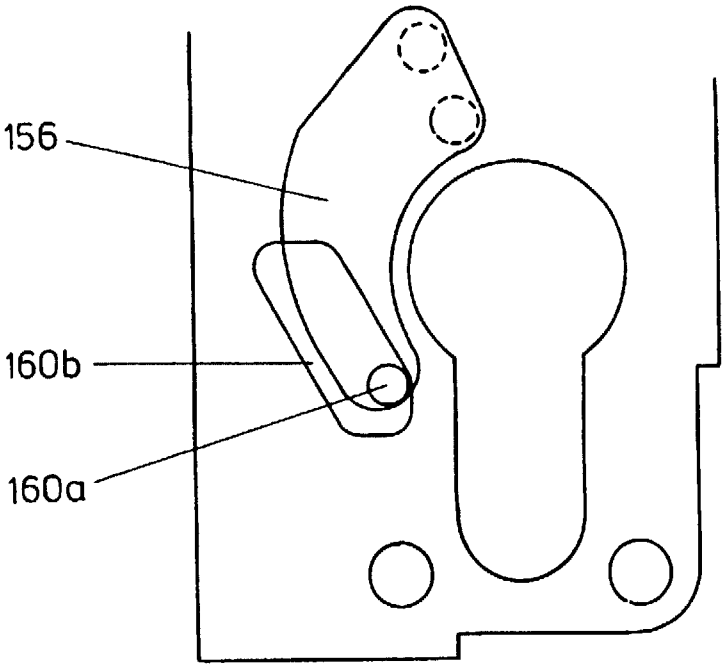
Figure 19:
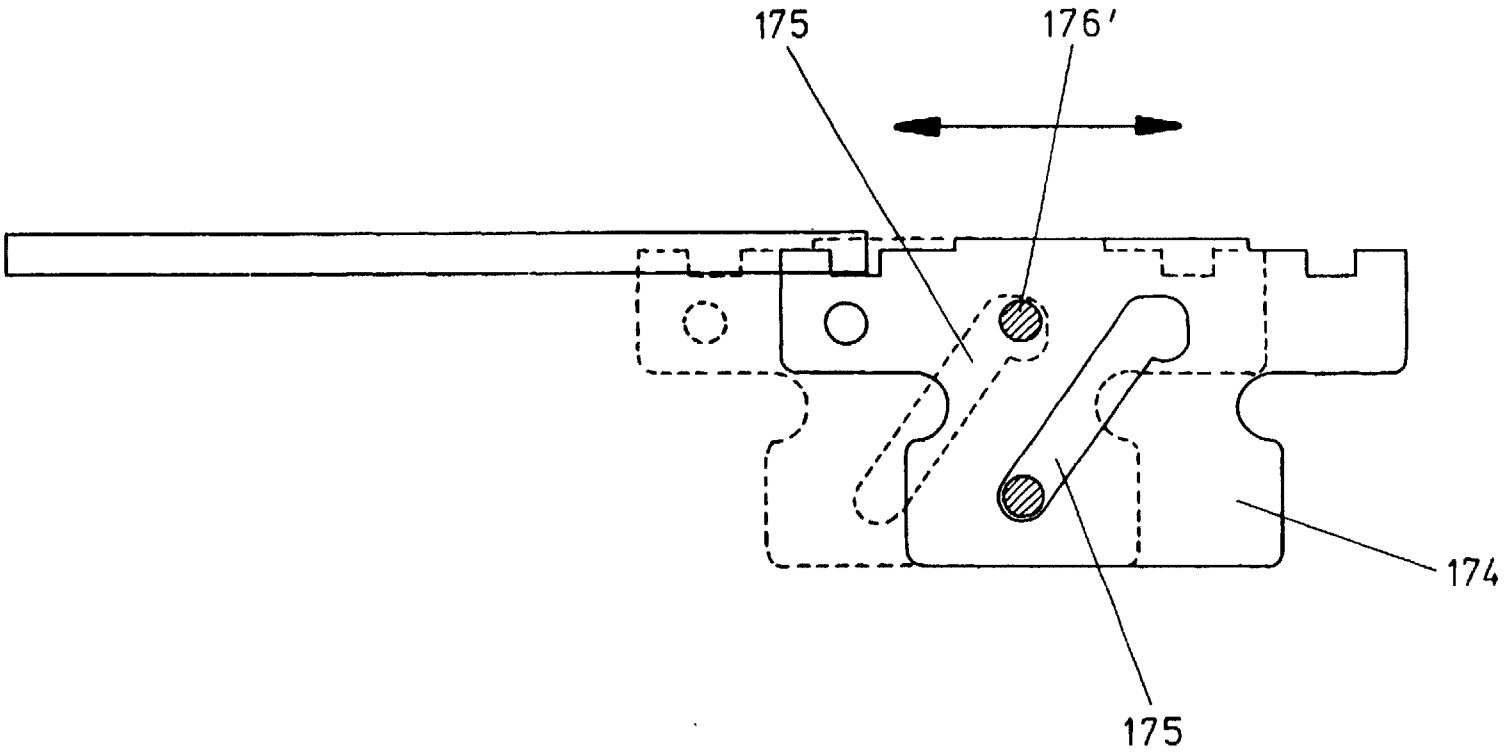
Figure 20:
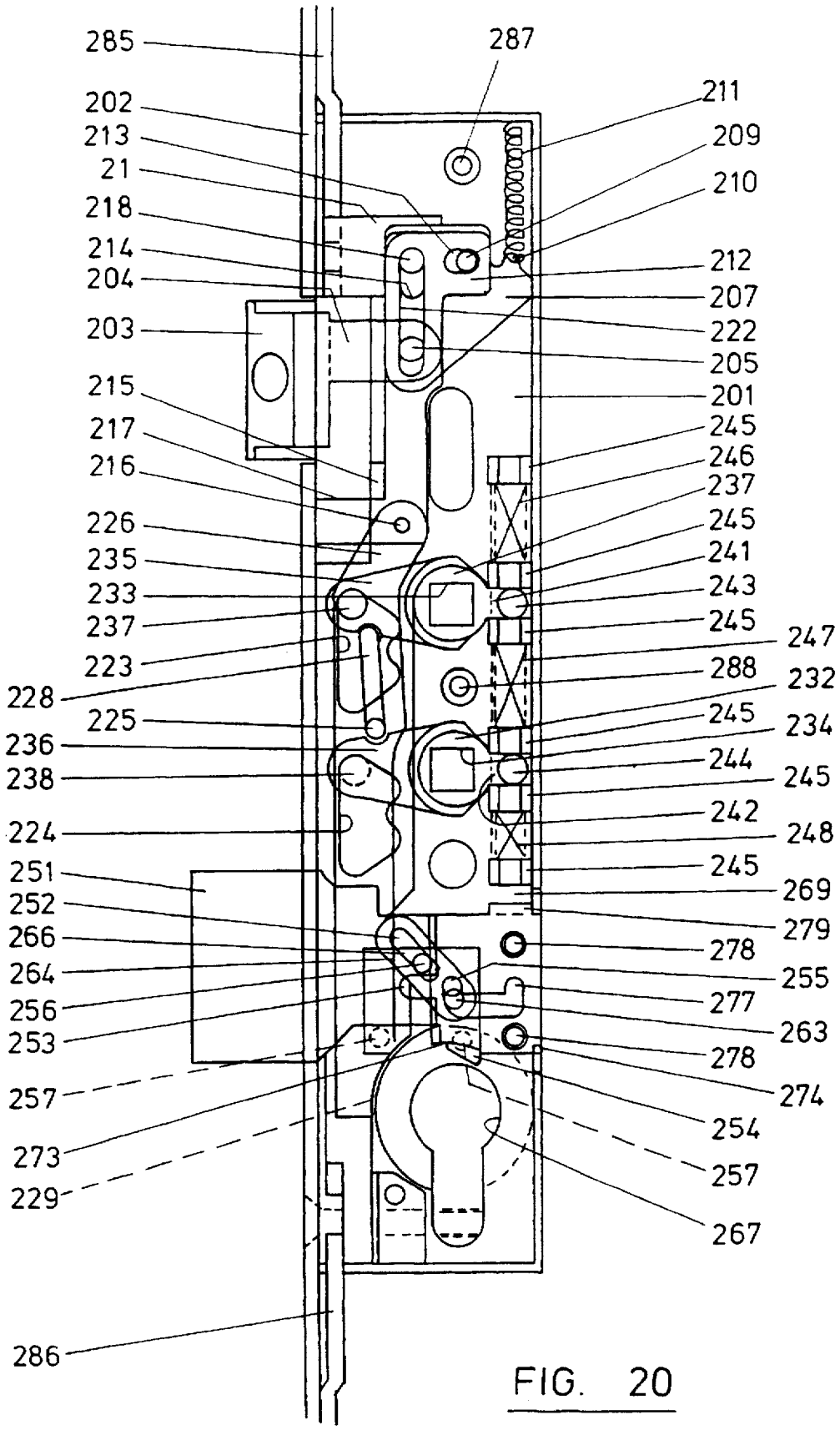
Figure 21:
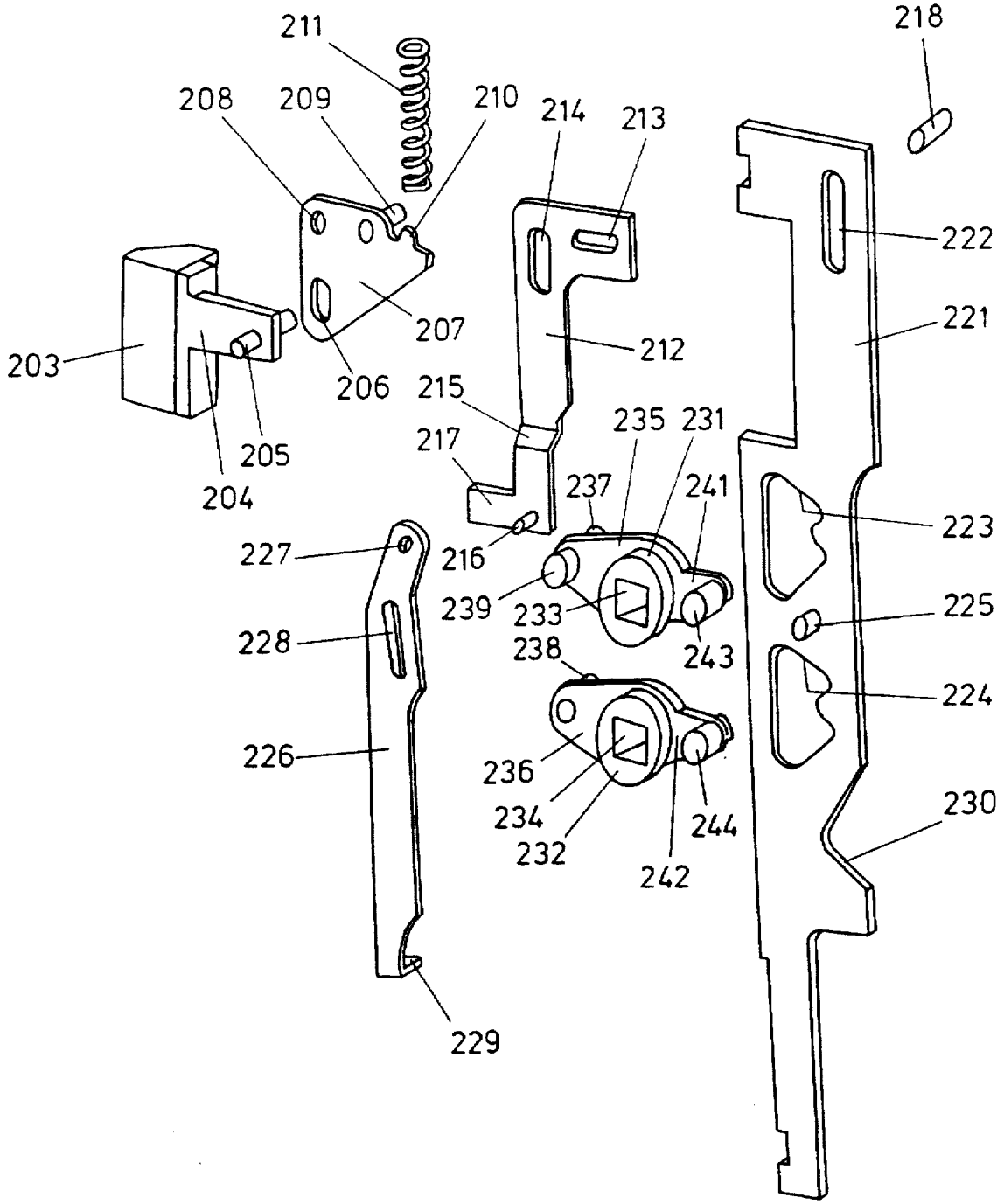
Figure 22:
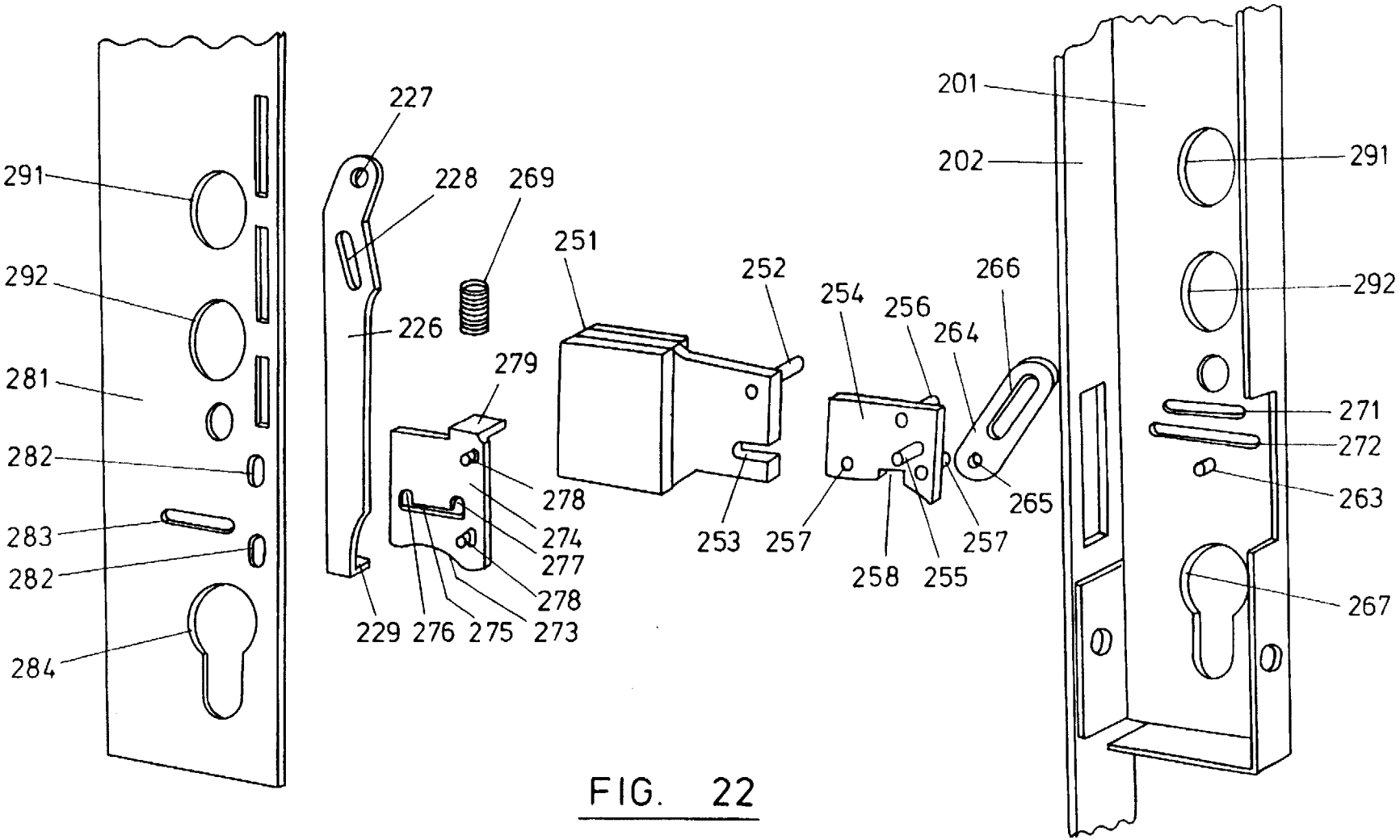
Figure 23:
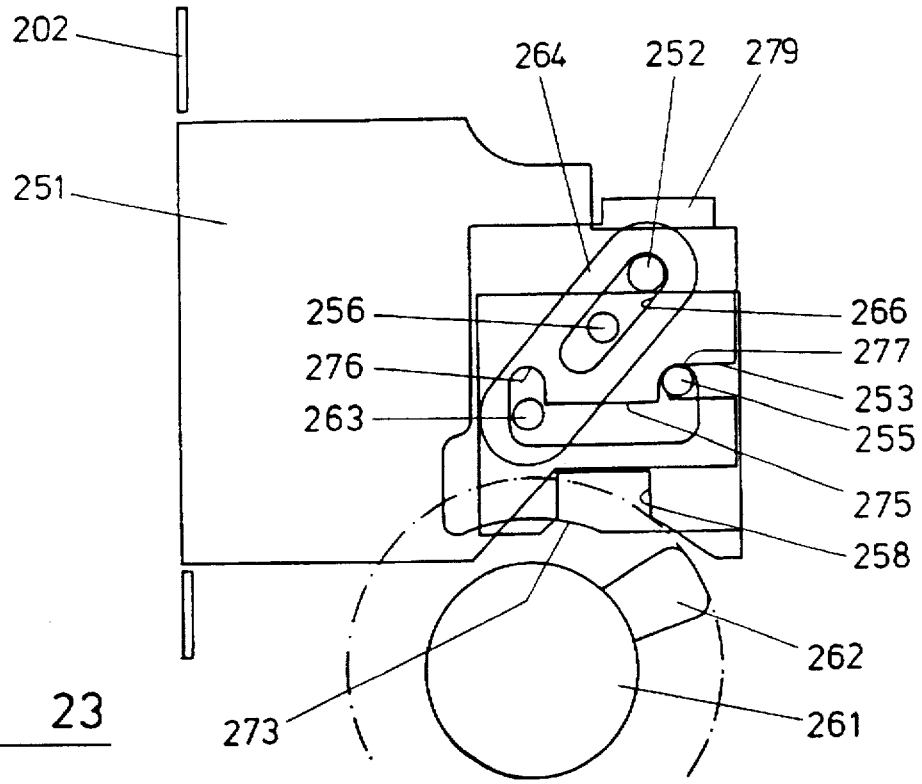
Figure 24:
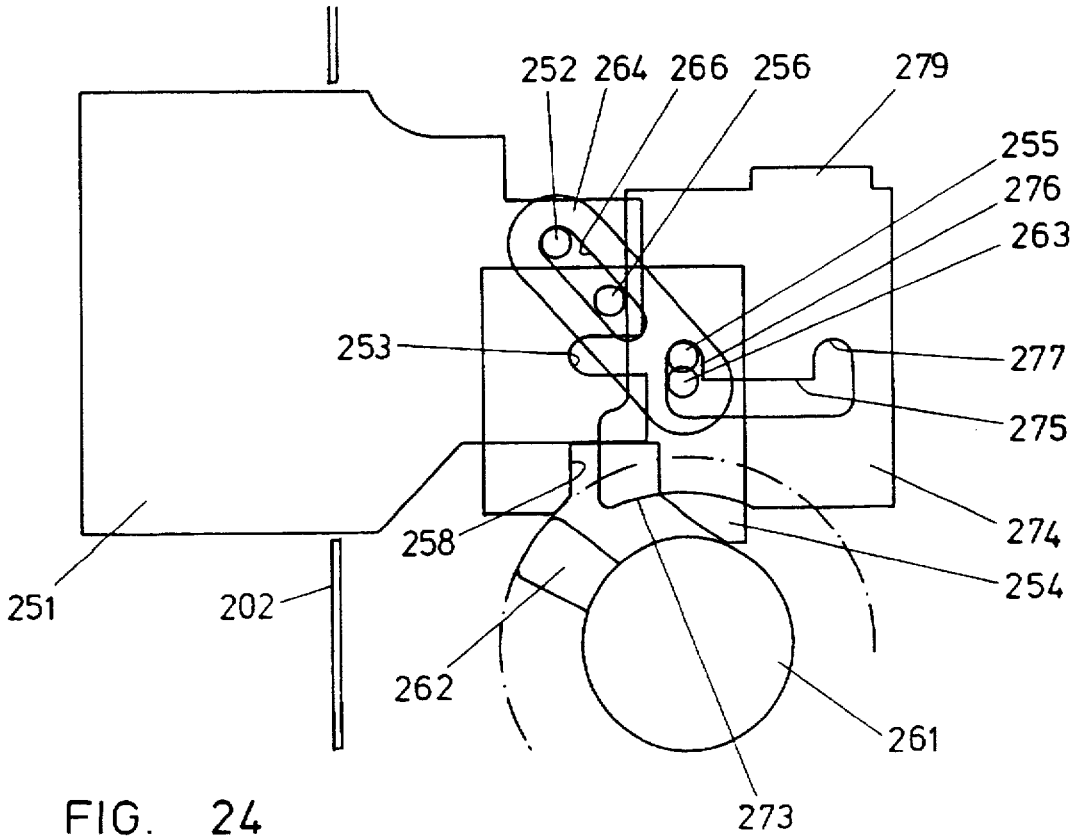
Figure 25:
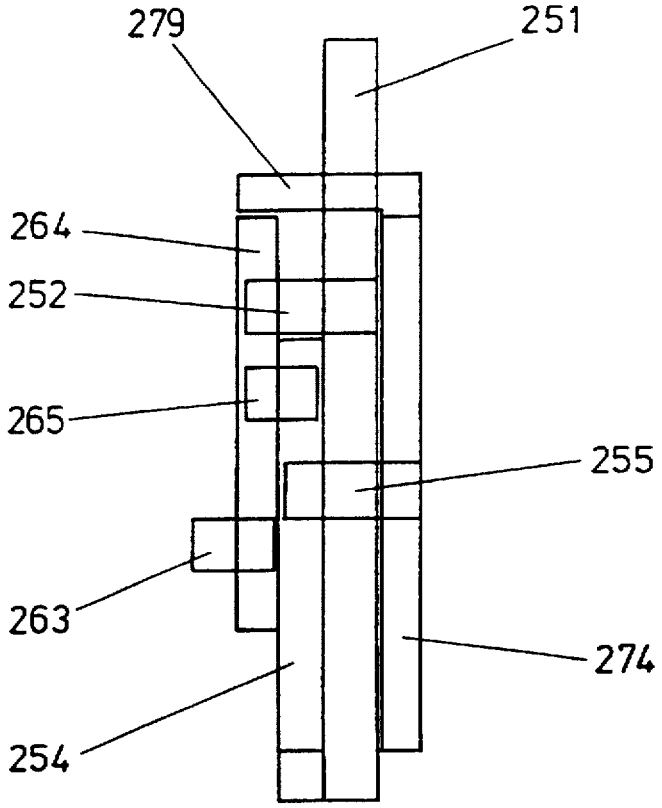

FIGS. 16*a* and 16*b* show respectively the neutral positions taken up by the handle spindles under spring bias, and when pivoted under handle action against the spring bias;

FIGS. 17A to 17E show, separately, some of the major operating components of the second embodiment of mortise lock;

FIGS. 18A and 18B show, respectively, unlocked positions and locked positions of the components shown in FIGS. 17A and 17C;

FIGS. 18C and 18D are detail views, similar to FIGS. 18A and 18B showing internal components of the lock in more detail;

FIG. 19 is a detailed view showing part of the operating mechanism to operate one of the additional deadbolts (one of the top and bottom deadbolts) by the second embodiment of mortise lock;

FIG. 20 is a side elevation of a further embodiment of a lock according to the invention;

FIG. 21 is an exploded perspective view of parts of a latch bolt assembly forming part of the lock shown in FIG. 20;

FIG. 22 is an exploded perspective view of parts of a deadbolt assembly forming part of the lock shown in FIG. 20;

FIG. 23 is a simplified view, to an enlarged scale, of the deadbolt assembly shown in FIG. 22 but with some components omitted in the interests of clarity, the assembly being shown in the unlocked condition;

FIG. 24 is a view corresponding to FIG. 23 but showing the assembly in the locked or thrown condition; and, FIG. 25 is an end view of the deadbolt assembly shown in FIG. 24.

In the drawings, like parts are denoted by like reference numerals.

Referring first to FIGS. 1 to 9 of the drawings, a mortise lock according to the invention comprises a casing 1 to one side of which is secured a fore plate 2. A latch bolt assembly comprising a bevelled bolt head 3, a bolt lathe 4 and a latch bolt drive 5 is reciprocally mounted in the casing, the lathe taking the form of a rod which extends through a bore in an upstanding projection 6 which extends from the base of the casing 1 and which acts as a latch bolt guide. A coil spring 7 is mounted on the rod 4 and bears at one end against the projection 6 and at the other end against the bolt head 3 to urge the bolt head to the position shown in FIG. 1 in which said bolt head projects through a slot in the plate 2 to be maintained normally proud of said plate 2. The latch bolt drive 5 is slidably mounted in a slot 8 in the casing for guiding the latch bolt assembly. A pair of lever arms 11, 11' are normally held by the spring 7 between the latch bolt drive 5 and the projection 6, the lever arm 11 comprising an extension of a follower arm in the form of a disc 12 which is adapted to be mounted on a first, or upper, drive shaft 16. The disc 12 is formed with a cam track 13 and a cam 17 projects from the drive shaft 16 and is engageable in the cam track. The drive shaft 16 is further provided with a square sectioned bore 18 for the reception of the square shaft of a door handle (not shown). Also mounted on the drive shaft 16 is a toothed gear pinion 21 having a recess for accommodating the cam 17 whereby rotation of the drive shaft 16 by a door handle is effective in turn to rotate the pinion 21. The pinion carries on one side an upstanding projection or peg 22.

Meshing with the pinion 21 is a second toothed gear pinion 23 which is mounted on a second or lower drive shaft 26. The drive shaft 26 is similar to the drive shaft 16 and has a projecting cam 27, which is engaged by a slot in the pinion 23, as well as a square sectioned bore 28 for the reception of the square shaft of a second door handle (likewise not shown). The pinion 23 also carries on one side an upstanding projection or peg 24.

The disc 12 further has a small projection 14 extending from its periphery on which a peg 15 is mounted, the peg engaging in a bore at one end of a link 31. The link 31 is arranged to be operated by the cam 54 of a cylinder 53 in a manner to be hereinafter described. The lever arm 11' comprises an extension of a second disc 12' which is similar to the disc 12 in that it has a cam track similar to the cam track 13 and a projection carrying a peg. In this case, however, one end of a spring (not shown) is secured to the peg and the other end of the spring is connected to the casing 1. The purpose of this spring is to act on the shaft 16 to return the door handle to its normal position in a manner known to those skilled in the art.

The mortise lock according to the invention further includes a deadbolt assembly comprising a deadbolt 41 which is adapted, in its thrown position, to project through a slot in the fore plate 2 as shown in FIG. I of the drawings and, in its withdrawn position, to be located within the casing 1 with its outer end substantially flush with the outer surface of the fore plate 2. The deadbolt has a curved recess 42 along one edge to accommodate a portion of the pinion 23 in the withdrawn position of the deadbolt and the said pinion has a flat region 25 along a portion of its periphery to permit the deadbolt to slide out of the casing without interference. The deadbolt 41 further has a first peg 43 projecting from one face which is engageable in a shaped slot 32 in the link 31 and a second peg 44 projecting from its other face which engages in an elongated slot 47 in a bolt driving link 46. Sandwiched between the deadbolt 41 and the link 31 is a detainer 35 with a shaped slot 36 through which the peg 43 passes to engage in the slot 32 in the link 31. The detainer also has two pegs 37, 38 which project from the same side of the detainer and which engage, respectively, in the slot 32 and in a further slot 33 in the link 31. The upper arm of the detainer is guided through a guide 9 which projects from the casing 1 and a coil spring 29 is mounted on the arm bearing at one end against the guide 9 and at the other end against the main body of the detainer 35.

In the unlocked position of the deadbolt assembly, the coil spring 29 is effective to urge the detainer to a position in which the peg 43 on the deadbolt 41 is engaged at position a in the slot 36. At the same time, the spring 7, acting on the latch bolt assembly, is effective to urge the link 31, via the linkage consisting of the follower arm and peg 15, to a position in which the peg 43 on the deadbolt 41 bears against the upper surface of the slot 32 in the region a. In the locked position of the dead lock assembly, the peg 43 on the deadbolt 41 is engaged at position b in the slots 32 and 36 respectively in the link 31 and detainer 35.

Figure 7:
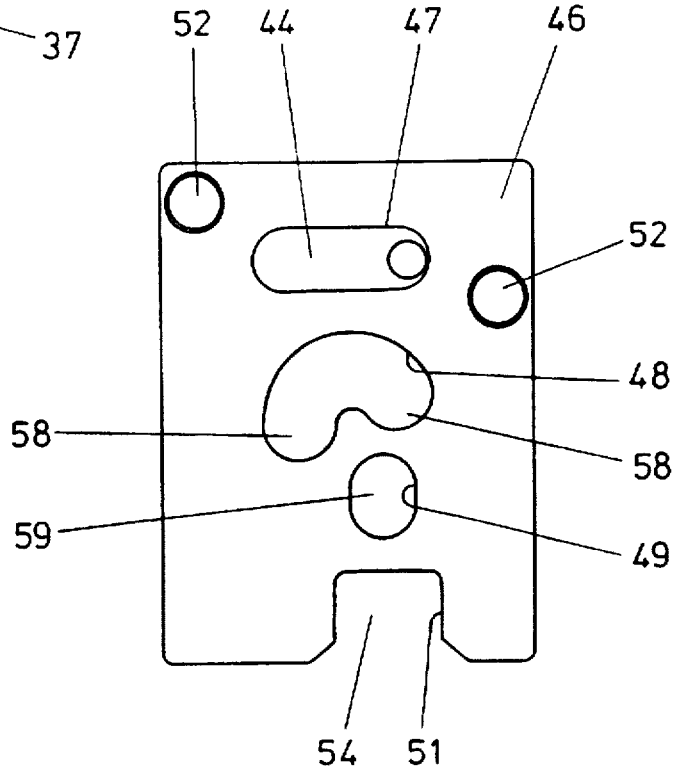
FIG. 7 shows a bolt driving link forming part of the deadbolt assembly.
Figure 8:
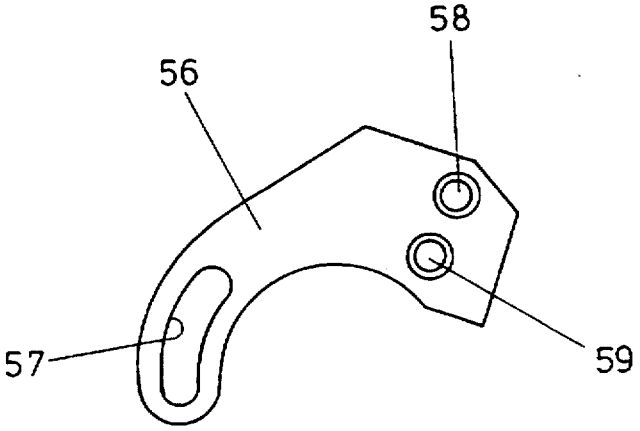
FIG. 8 shows a quadrant forming part of the deadbolt assembly.

As shown more clearly in FIG. 7 of the drawings, the bolt driving link 46, in addition to the elongated slot 47, has a kidney-shaped slot 48 and a further vertical slot 49 as well as a cut-out 51 which is adapted to receive the cam 54 of the cylinder 53. A pair of pegs 52 also project from the side of the link 46 remote from bolt 41, said pegs being arranged to slide along respective slots 72 provided in a casing cover plate 10 (FIG. 9) when the bolt is moved thereby ensuring accurate movement of the link and the bolt in the longitudinal direction.

Mounted over the bolt driving link is a bolt drive quadrant 56 having a pair of pegs 58, 59 projecting from one side which engage, respectively, in the slots 48, 49 in the link 46. The quadrant is further provided with a curved guide slot 57 which is engaged over a guide pin 19 projecting from the casing 1. The peg 58 is longer than the peg 59 and projects through the kidney-shaped slot 48 in the link 46 to engage in the vertical slot 45 in the deadbolt 41.

The cylinder 53 is located in a key-hole slot provided in the casing 1 and the cam 54 can be turned when a key (not shown) is inserted into the cylinder 53 and turned. The cam 54 is engageable in the cut-out slot 51 in the link 46 (and acts as a key-operated lever to drive the operation of the lock) and is also arranged to bear against curved surfaces 34 and 39 provided respectively on the link 31 and detainer 35. As stated above, the maximum bolt projection that can normally be obtained by direct drive from a cylinder cam is of the order of 14 mm. The projection is limited by the dimensional relationship between the radius of the cylinder housing and the radius of the operating arm or cam. In angular terms, this represents about 40° rotation in total.

The mechanism according to the invention as above described depends on effectively extending the radius at which the motion is transmitted so that for 40° rotation a longer chord is generated, in the ratio of 14:20. When the key in the cylinder 53 is turned to rotate the cam 54, the cam is first effective to engage the curved surface 39 on the detainer 35 to lift the same so that the slot 36 is moved to a position in which the peg 43 on the deadbolt 41 is capable of lateral movement in said slot. The cam 54 then enters the slot 51 in the link 46 and is effective to move the link. By virtue of the engagement of the pegs 52 in the slots 72 in the casing cover 10, the link 46 can only move in a longitudinal direction towards the fore plate 2. This longitudinal movement of the link 46 is transferred via the peg 59 to the quadrant 56 which in turn moves the bolt 41 by virtue of the engagement of the peg 58 in the slot 45. While the link 46 can be driven directly by the cam by a distance of only 14 mm, further longitudinal movement of the deadbolt 41 is achieved by means of the quadrant 56. The peg 58 is located in the quadrant at such a distance from the axis of the cylinder that 40° rotation of the cam 54 results in a chordial distance of 20 mm.

The shape of the slot 48 in the link 46 is such as to allow for the peg 58 to move through an arc. It is important for the quadrant to rotate truly around the centre of the cylinder 53 as though it was a full circle or ring and this is achieved by the combined effects of the kidney-shaped slot 48 and the curved slot 57 which is guided on the guide pin 19. Since the deadbolt 41 and the link 46 travel in the same direction but at different rates, i.e. 20 mm and 14 mm respectively in the illustrated example, the profile of the kidney-shaped slot 48 must allow for only the actual relative change in position between them, i.e. 6 mm in the illustrated example, and the corresponding position of the radius at which the peg 58 travels has to be contained within this profile. The pegs 52 on the link 46 serve as guide pins to keep the link in proper alignment with, i.e. parallel to, the deadbolt 41.

When thrown to its full extent, the deadbolt 41 is secured at that position by the detainer 35 which is driven onto the peg 44 which acts as a detaining pin on the bolt 41 by the spring 29 when the cam 54 is turned beyond the curved surface 39 which acts as a lifting edge for the detainer. The detainer is raised by engagement of the cam 54 with the surface 39 when the cam is turned in the opposite direction so that the detaining pin 44 is no longer engaged in the recess b in the slot 36 and the deadbolt 41 can then be withdrawn into the casing 41.

The mortise lock according to the invention further includes an additional mechanism comprising a pair of slide bolt shoot rods 61 and 62. The upper rod 61 projects through a slot in the upper wall of the casing 1 and is connected to one edge of a first slide bolt bridge 63 which is slidably mounted in the casing. The opposite edge of the bridge 63 is connected to one end of a link 65. The other end of the link 65 carries a projection 67 in which a slot is formed for engagement by the peg 22 on the pinion 21. In like manner, the lower rod 62 projects through a slot in the lower wall of the casing 1 and is connected to one edge of a second slide bolt bridge 64 which is slidably mounted in the casing. The opposite edge of the bridge 64 is connected to one end of a link 66. The other end of the link 66 carries a projection 68 in which a slot is formed for engagement by the peg 24 on the pinion 23.

Figure 1:
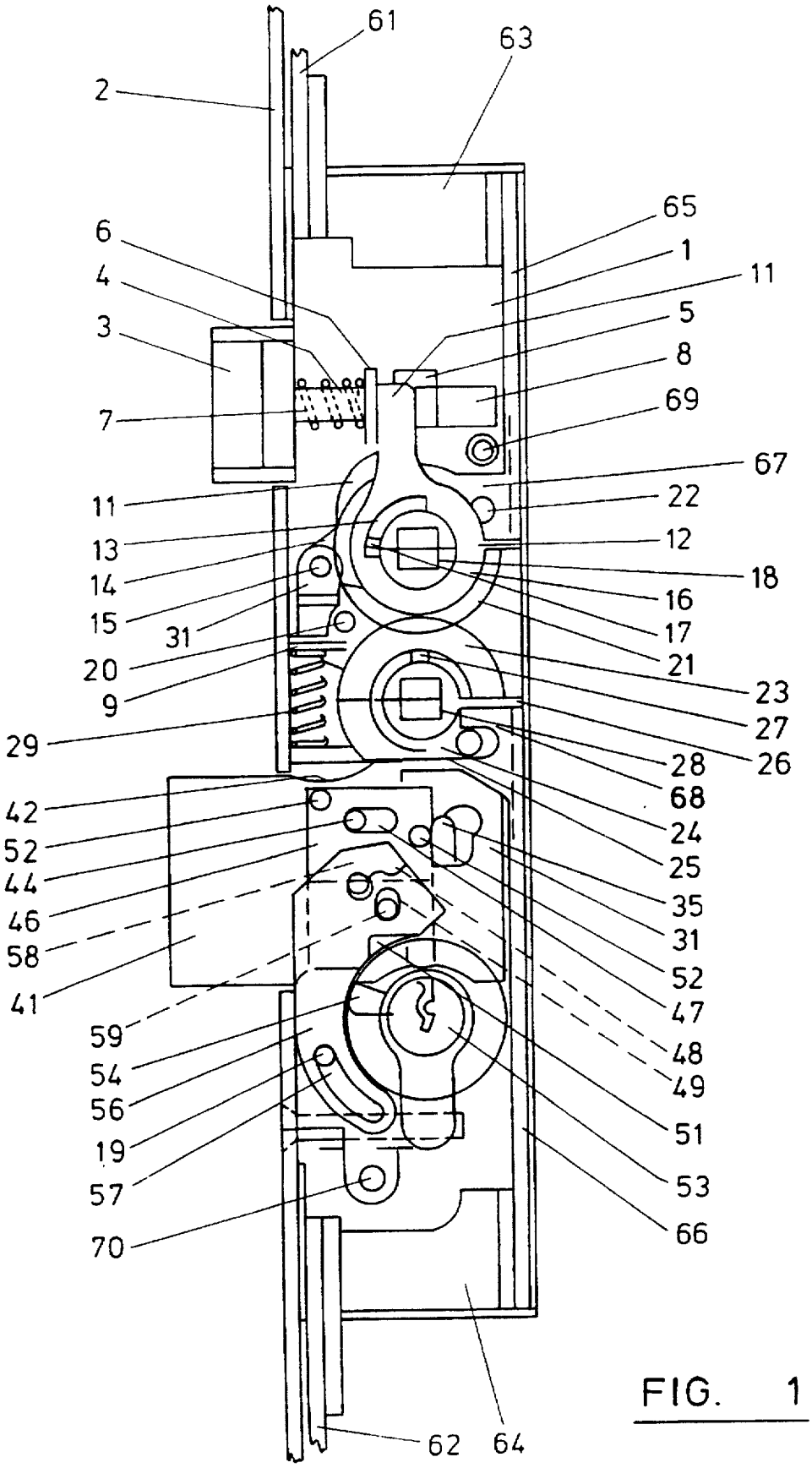
FIG. 1 is a side elevation of one embodiment of a mortise lock according to the invention.
Figure 5:
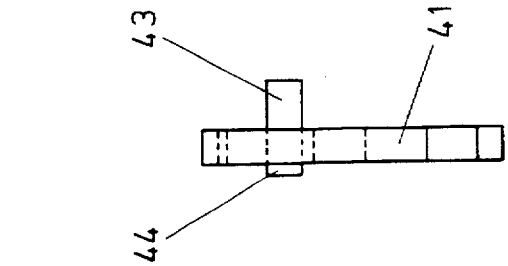
FIG. 5 is an end view of the deadbolt shown in FIG. 4.
Figure 4:
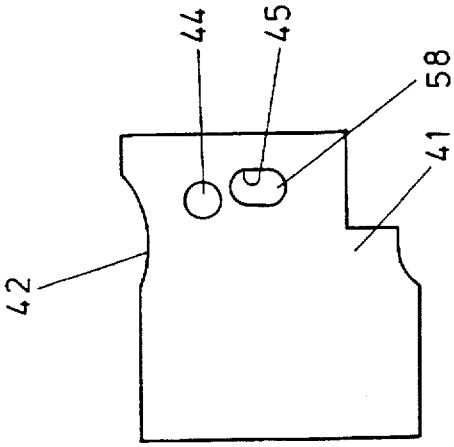
FIG. 4 is a side view of a deadbolt forming part of a deadbolt assembly of the mortise lock according to the invention.
Figure 3:
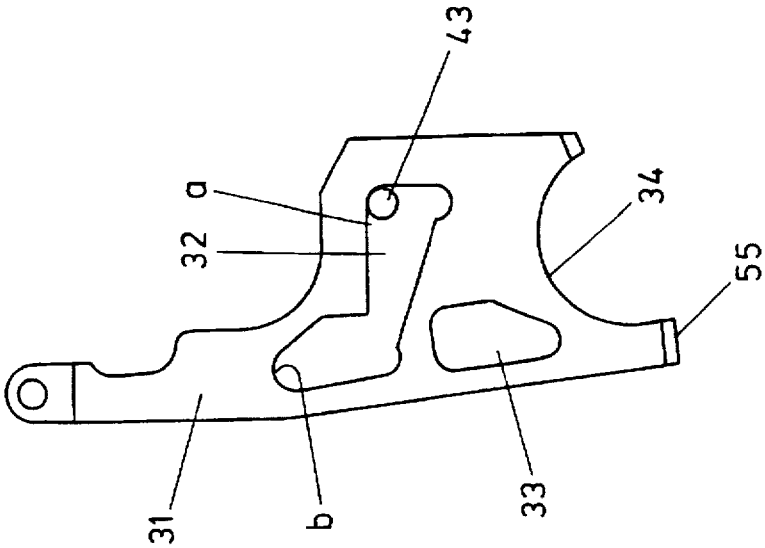
FIG. 3 shows a link between the latch bolt assembly and the cylinder of the mortise lock shown in FIG. 1.
Figure 2:
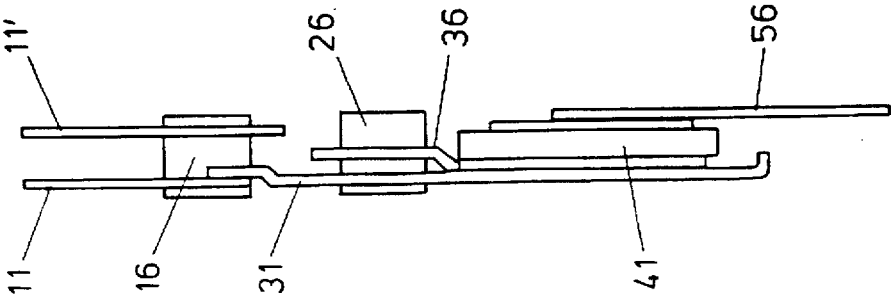
FIG. 2 is a section taken on the line II—II in FIG. 1 in the direction of the arrows but with some components omitted in the interests of clarity.
Figure 6:
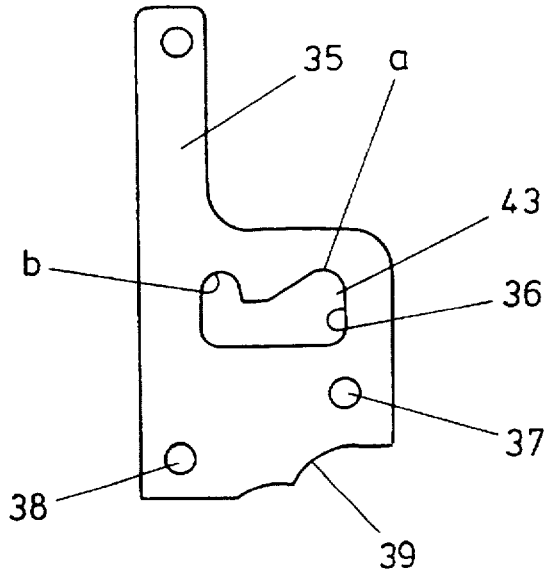
FIG. 6 shows a detainer forming part of the deadbolt assembly.

FIG. 1 of the drawings shows bolt shoot rods 61, 62 in positions in which they are effective to operate additional bolts along the leading edge of top and bottom edges of a door fitted with the lock according to the invention. The deadbolt 41 is also shown in the locked or thrown position and, when the deadbolt is in this position, the bolt shoot rods cannot be withdrawn because the flattened region 25 of the pinion 23 is engaged by the rear end of the deadbolt 41 to immobilise the pinion. Since the pinion 23 is meshed with the pinion 21, the latter is also immobilised.

In order to withdraw the bolt shoot rods 61, 62 it is first necessary to unlock the deadbolt 41 by moving it to its withdrawn position within the casing 1. In this position, the recess 42 is located in the path of movement of the pinion 23. The drive shaft 16 can now be turned by means of a handle (not shown) in a clockwise direction as viewed in FIG. 1 to rotate the pinion 21 likewise in a clockwise direction and the meshing pinion 23 in an anti-clockwise direction. The pegs 22, 24 are rotated with their respective pinions 21, 23 and serve to entrain the links 65, 66 respectively whereby the bridges 63, 64 are drawn towards the pinions 21, 23 respectively and the slide bolt shoot rods 61, 62 are withdrawn. The latch bolt head 3 can then be withdrawn in order to open the door by further movement of the drive shaft in a clockwise direction by means of the handle (not shown).

When the mortise lock according to the invention is fitted to an outside door of a property and the owner of the property wishes to leave the property, the door must first be opened by withdrawing the latch bolt 3 as above described. The door can then be opened and the owner can exit the property. The door can then be pulled shut which latches it. The door handle should then be pushed up which is effective to rotate the drive shaft 16 in an anti-clockwise direction, as viewed in FIG. 1 which drives the pinions 21, 23 which are effective, by virtue of the linkages formed respectively by the pegs 22, 24, the links 65, 66 and the bridges 63, 64 to throw the bolt shoot rods 61, 62 into the locked or bolted position. The cam 54 of the cylinder 53 is then turned by means of a key in the cylinder to throw the dead lock bolt 41 and to lock the pinions 21, 23 so that the bolt rods 61, 62 cannot be withdrawn. The key is then withdrawn from the cylinder and the owner can leave his property safely dead-locked.

On returning to the property, the door can only be opened by inserting the key into the cylinder 53 and turning the cam 54 to withdraw the deadbolt 41 and unlock the pinion 23. The drive shaft 16 can then be turned in a clockwise direction, as viewed in FIG. 1, to withdraw the slide bolt shoot rods 61, 62 as above described. Further movement of the drive shaft 16 by means of the handle is effective to withdraw the latch bolt, the door can then be opened and the owner can enter the property.

It is important to note, however, that the door cannot be deadlocked from the inside by means of the slide bolt shoot rods 61 and 62 because a door handle is accessible from the outside of the door and these bolts can be withdrawn simply by turning the handle. The door can only be deadlocked by turning the key in the cylinder to operate the deadbolt 41. This is inconvenient and in a further aspect the present invention also aims to overcome this problem by means of the preferred embodiment illustrated in the drawings.

According to the preferred embodiment, a handle is fitted to the drive shaft 16 only on the side of the door which is inside the property. A second handle (not shown) is fitted to the drive shaft 26 on the side of the door which is on the outside of the property. With this arrangement, when the owner of the property wishes to leave, the latch bolt 3 is withdrawn by turning the shaft 16 in a clockwise direction (as viewed in FIG. 1) as before and the door is opened. The door can then be pulled shut behind the owner which latches the door. The drive shaft 26 is then turned by the handle on the side of the door in a clockwise direction as viewed in FIG. 1 which rotates the pinion 23 in the same direction. By virtue of its engagement with the pinion 21, rotation of the pinion 23 is effective to move both of the slide bolts 61 and 62 to the thrown, dead-locked, positions. The cam 54 can then be turned by means of a key in the cylinder 53 to throw the deadbolt 41 to its dead-locked position as above described and, once the key is removed from the cylinder, the door is securely dead-locked and the handle fitting in the drive shaft 26 cannot be turned.

On returning to the property, the door can only be opened by inserting the key into the cylinder 53 and turning the cam 54 to withdraw the deadbolt 41. The drive shaft 26 can then be rotated in an anti-clockwise direction as viewed in FIG. 1 to withdraw the bolt rods 61 and 62 in the manner above described. The door however is still latched by the latch bolt 3 and still cannot be opened by the handle in the drive shaft 26. In order to open the door, it is necessary to turn the key further to rotate the cam in a clockwise direction as viewed in FIG. 1 until it engages a projection 55 at the lower end of the link 31. Further turning of the key in the cylinder 53 causes the cam 54 to move the link 31 in an upwards direction by virtue of the engagement of the projection 55 by the cam. This upwards movement of the link 31 causes the disc 12 to rotate by virtue of the engagement of the link 31 by the peg 15 and the lever arm 11 therefore acts on the latch bolt drive 5 to withdraw the latch bolt 3. The door can then be opened and the key withdrawn from the cylinder. The owner can then enter the property and the door can be pushed shut to latch it. The door will remain in its latched position and cannot be opened from the outside because the handle on the drive shaft 26 is incapable of operating the latch bolt. If the handle on the outside of the door is turned it will only serve to throw or withdraw the slide bolt rods 61 and 62. The property is therefore secure.

When the disc 12 is rotated by turning the cam 54 to act on the link 31, the drive shaft 16 is not rotated because the cam 17 is located in the cam track 13 which permits relative rotation to take place between the disc 12 and drive shaft 16.

It should be noted that, with this arrangement the door can only be opened from the outside by inserting a suitable key in the cylinder 53. Care should therefore be taken when vacating the property that the owner has the key since otherwise the owner would be locked out of his (or her) own property.

Preferably, the pinions are so arranged that they rotate through approximately 90° in order to throw or withdraw the bolt rods 61 and 62. The outside handle is desirably so arranged in the drive shaft 26 that, in the thrown or locked position of the bolt rods 61, 62, it is substantially horizontal and, in the withdrawn or unlocked position of the bolt rods, it is substantially vertical and pointing upwards. The inside handle, on the other hand, is desirably so arranged in the drive shaft 16 that, in the thrown or locked position of the bolt rods 61, 62, it is substantially vertical with the handle pointing upwards and, in the withdrawn or unlocked position of the bolt rods, it is substantially horizontal.

Figure 9:
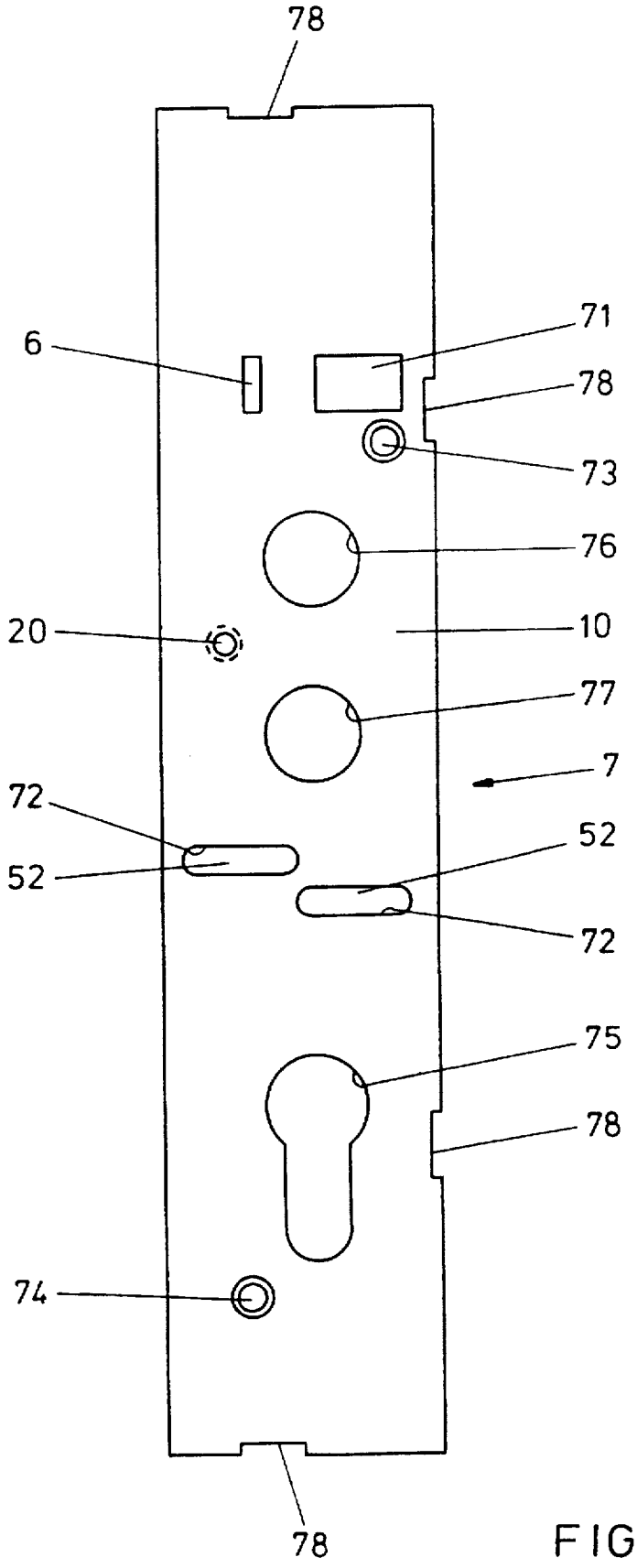
FIG. 9 is a front view of a cover plate for the casing of the lock shown in FIG. 1.

The lock casing 1 is provided with a cover plate 10 which is illustrated in FIG. 9 of the drawings. In order to secure the cover plate to the casing, the latter is provided with a pair of upstanding pegs 69, 70 which are provided with screw-threaded bores and the cover plate 10 is provided with aligned holes 73, 74 respectively by means of which the cover plate can be secured to the casing by screws (not shown) which engage through the holes 73, 74 in the screw-threaded bores in the pegs 69 and 70. The cover plate 10 is further provided with a slot for receiving the latch bolt guide 6, which assists in ensuring that the cover plate is correctly registered with the casing, and with a slot 71 for receiving and guiding the latch bolt drive 5. A further locating pin 20 projecting from the casing 1 is located in a round bore in the cover plate 10 again to ensure correct registry of the cover plate with the casing. A key hole slot 75 is further provided in the cover plate to accommodate the cylinder 53 and circular bores 76 and 77 are provided to engage the drive shafts 16 and 17 respectively to hold said drive shafts in position in the casing. Finally, the cover plate may further be provided with recesses 78 around its periphery which are designed to engage with corresponding ribs on the edges of the casing walls (not shown) again to ensure correct registry of the cover plate with the casing.

Although as stated in the foregoing, the lock according to the invention is primarily intended for use with narrow style doors made of UPVC or similar materials, it will be appreciated that the lock is not restricted to use with such doors but is suitable for use with any door including solid wooden doors or steel or aluminium doors.

Further, the invention is not restricted to the above described and illustrated embodiment but variations and modifications may be made without departing from the scope of the invention. For example, the deadbolt assembly may be employed in a lock without the slide bolt shoot rods. It is also possible to utilise the feature of the slide bolt shoot rods, with or without the provision of a second handle drive shaft, without utilising the feature of the deadbolt assembly with the enhanced throw or, indeed, in a lock having no additional deadbolt assembly at all.

Further embodiments of the invention will now be described with reference to FIGS. 10 to 19 of the accompanying drawings, and in which parts corresponding directly with those previously described and illustrated in FIGS. 1 to 9 are given the same reference numerals, and will not be described in detail again. In addition, parts which generally correspond with those previously described, but which have been significantly modified, are given the same reference numerals but with the addition of 100.

Accordingly, and as will be described in more detail below, bolt drive quadrant 56 is replaced by bolt drive quadrant 156, bolt driving link 46 by link 146, latch link 31 by link 131, detainer 35 by detainer 135 (spring loaded via leaf spring 135*a*) and deadbolt 41 by bolt 141.

This further embodiment also includes a different arrangement for operating top and bottom deadbolts (in addition to the central deadbolt) and a different mechanism to effect key-operated unlatching of the lock from what will usually be the "outside" of the door or window in which the lock is mounted. However, description will first be made of the modified components of the key operated central dead lock arrangement.

The modified components are shown in FIG. 17, in which references A to E designate, respectively, modified quadrant drive 156, drive link 146, deadbolt 141, detainer 135 and latch link 131. Detainer 135 can be moved under cam action against the spring 135*a*, but which can return under spring action after disengagement of the cam.

The driving link 146 still has cut-out 51 which receives the cam 54 of the cylinder lock, and which causes linear reciprocation of the link 146 upon rotation of the cylinder lock. However, the means by which this linear movement is transferred to the deadbolt 141 is different, in that a continuous multiplier effect obtains throughout the major part of the key operated motion of the driving link 146. This compares with the operation of the driving link 46, in which a two part motion is provided, namely a first part in which linear motion is transmitted direct to the bolt 41 via the right hand edge of slot 47 in link 46 and peg 44 projecting from bolt 41, and a second part in which the link 46 (via interconnection between peg 59 and slot 49) causes the quadrant 56 to pivot and thereby apply additional linear movement to the bolt 41 via peg 58 and slot 45.

However, in this further embodiment, the modified quadrant 156 has a tail end 160 which is guided so as to cause the quadrant 156 to pivot about peg 59 and thereby apply direct transmission of linear motion to the bolt 141 via peg 58 which engages in slot 45 in deadbolt 141 (see FIG. 17C). However, tail 160 has a boss 160*a* which is guided by a slot 160*b* (see FIGS. 18C and 18D) in a guide plate, so that upon initial turning of the key-operated lock, the link 146 is moved via cam 58 and this also causes the quadrant tail 160 to slide towards the front face 161 of the housing, which it quickly engages, and in conjunction with the guidance of boss 160*a* this then causes linear transmission of movement to the deadbolt 141.

There is therefore an almost immediate multiplier effect, whereby the "throw" of the deadbolt 141 is increased more than otherwise would be possible via direct transmission of the linear movement of the link 146 by cam 58. Furthermore, this will be a smooth type of application of driving force to the deadbolt.

FIG. 18A and B shows the modified quadrant 156 and deadbolt 141 only, and respectively the unlocked and locked positions. This shows the linear reciprocation of the deadbolt 141, as well as the combined sliding and pivotable movement which takes place for the quadrant 156 upon operation of the key operated lock.

This redesign of the quadrant and related components enables the overall depth of the housing (depth being measured in a direction perpendicular to the front face 161 of the housing) to be reduced, compared with the housing shown in FIGS. 1 to 9, and this is advantageous for fitting of the lock and housing in certain types of profile.

The construction of detainer 135 is generally similar to that of detainer 35, but with a different shape of recess 136, and cam face 139 as shown.

Latch link 131 is also similar to latch 31, but has a different shape of recess 132 and projection 155, when compared with recess 32 and projection 55 of link 31; and also has a different means of transmitting rotation to upper handle disc 112 of a two spindle drive assembly (see references 171 and 172 in FIGS. 14 and 15 as described in more detail below). By the transmission of generally linear movement to the link 131 under operation of the key operated lock, disc 112 of upper spindle 171 can be pivoted in order to effect unlatching of a spring loaded latch head 103 under key operated action only from the "outside" of a window or door provided with the lock.

This will be described below with reference to FIGS. 11A and 11B (in which certain parts are omitted for ease of understanding) and in more detail in FIGS. 12 and 13.

Figure 13:
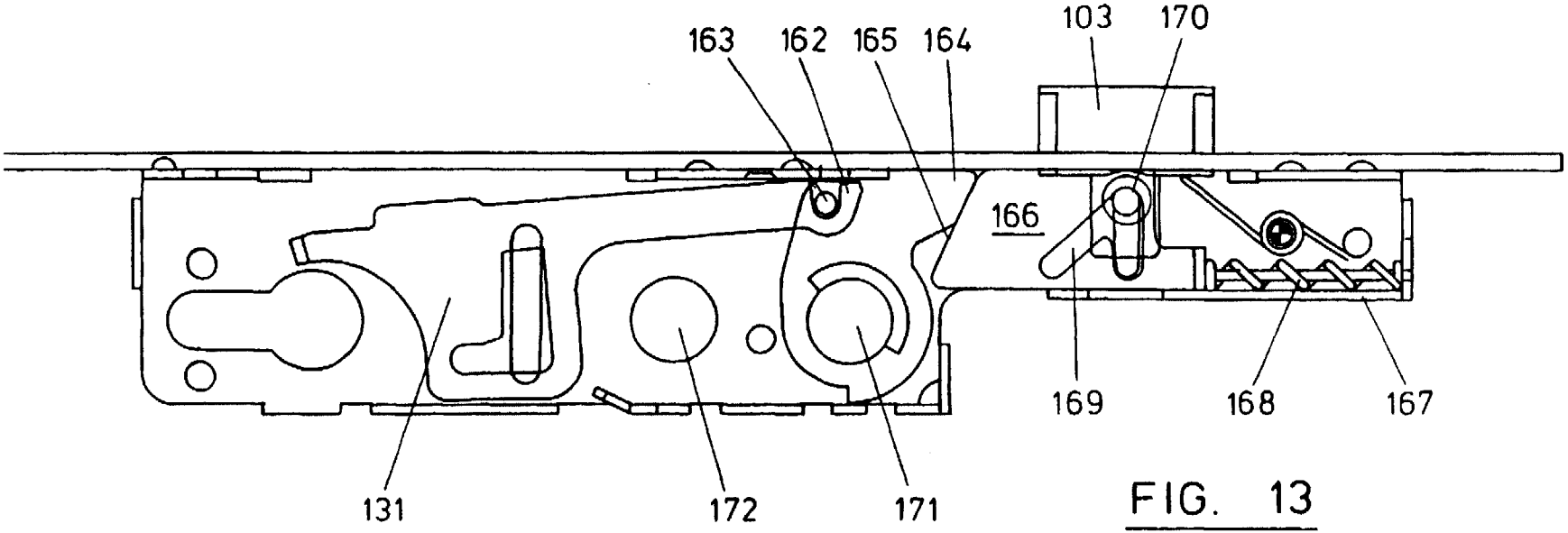
FIG. 13 illustrates the positions taken up by the components of FIG. 12, prior to key operated release.

FIG. 13 shows the lock in an unlocked position i.e. it is assumed that the key operated lock has been operated partially in an unlocking direction in order to effect unlocking of both the central deadbolt 141, and also top and bottom deadbolts (to be described in more detail below), but by reason of the fact that the internal design of the lock is deliberately made such that operation of the external handle (mounted on spindle 171) is to be incapable of effecting unlatching, a novel assembly of link 131 and operating mechanism for spring loaded latch head 103 is provided, which will now be described.

Figure 12:
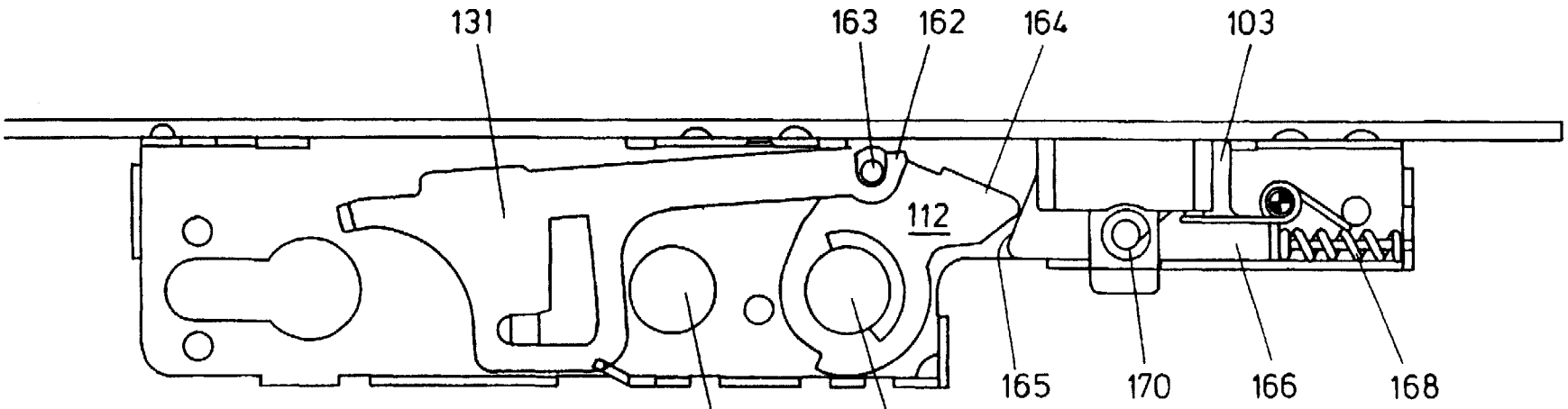
FIG. 12 is an illustration, again with parts omitted for clarity, showing the means by which the latch head can be released by key operation from externally of a door or window in which the mortise lock is provided.

Latch link 131 has a hooked end 162, (see FIG. 17E and FIGS. 12 and 13) and which engages a peg or other projection 163 of spindle disc 112, and upon application of generally linear movement (to the right in FIG. 13) of the link under further and final unlocking rotation of the key operated lock, the disc 112 pivots clockwise to the unlatching position shown in FIG. 12. The disc 112 has a nose 164 which engages an inclined cam face 165 of a slider 166 which is capable of linear movement within the housing in a direction perpendicular to the direction of reciprocation of latch head 103.

It should be noted that the linear reciprocation of latch link 131, under the final unlocking rotation of the key operated lock cylinder, can only take place after the latch link 131 has pivoted about pivot 163 in anti-clockwise direction to take up the unlatching position shown in FIG. 13. This movement of the latch link 131 can only take place after unlocking i.e. withdrawal of the central deadbolt 141 by unlocking rotation of the key operated lock, and the subsequent and second step of unlocking the top and bottom deadbolts by a mechanism shown in more detail in FIG. 19, and which will be described later.

Going back to the key operated unlatching from externally of the lock, as shown in FIG. 12, the slider 166 is capable of moving linearly to the right as shown in FIG. 13, against resilient opposition provided by compression spring 168, upon pivoting of the spindle disc 112. It should be noted that the slider 166 is of relatively shallow depth (depth being measured in the direction of linear reciprocation of the latch head 103), and this enables a projecting end portion 167 of the lock housing to be of correspondingly reduced depth also, which facilitates installation of the lock and its housing in certain types of profile. The housing part 167 is designed to allow linear sliding movement of the slider 166.

The spring 168 therefore tends to bias the slider 166 to take-up the latching position shown in FIG. 13, but is able to yield, as shown in FIG. 12, when it is required to effect unlatching of the latch head 103.

To transfer the linear sliding movement of slider 166 into perpendicular reciprocation of latch head 103, the slider 166 has an inclined cam groove 169 in which a projection 170 on an internal stem part of latch head 103 can be received, and evidently movement of slider 166 to the right, from the position shown in FIG. 13, will result in withdrawal of the latch head 103 to take-up the unlatched position shown in FIG. 12. Desirably, the construction and assembly of latch 103 is such that it can be reversibly mounted, to provide an "oppositely handed" lock.

Therefore, unlatching of the door from the outside can only take place by operation of the key operated lock, and this only by an appropriate sequence of events. This provides an additional safety feature, in that authorised opening of the lock from externally can only be achieved by operation of the key operated cylinder lock, even if the door is only "latched" i.e. with the latch head 103 in the latching position, and regardless of whether or not the central deadbolt and the top and bottom deadbolts are locked, or unlocked.

By contrast, with regard to internal unlatching, the latch head 103 can be moved to the withdrawn position by operation of the internal handle which will be mounted on upper spindle 171, and which can apply direct unlatching by rotation of disc 112 and corresponding movement of slider 166 and latch head 103.

When viewed from externally of the lock, there will be an outer handle which is mounted on lower spindle 172, but operation of this external handle will be quite incapable of having any effect on the release of latch head 103.

Figure 11B:
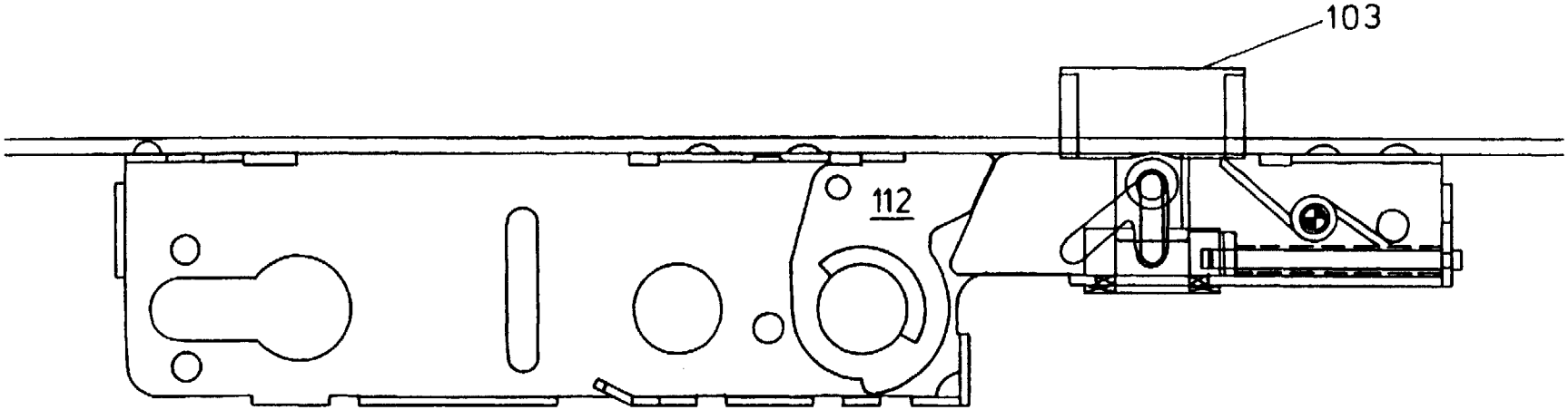
FIGS. 11A and 11B are plan views, with parts omitted for ease of understanding, and showing respectively, open position and closed position of a reciprocating latch head of the lock.
Figure 11A:
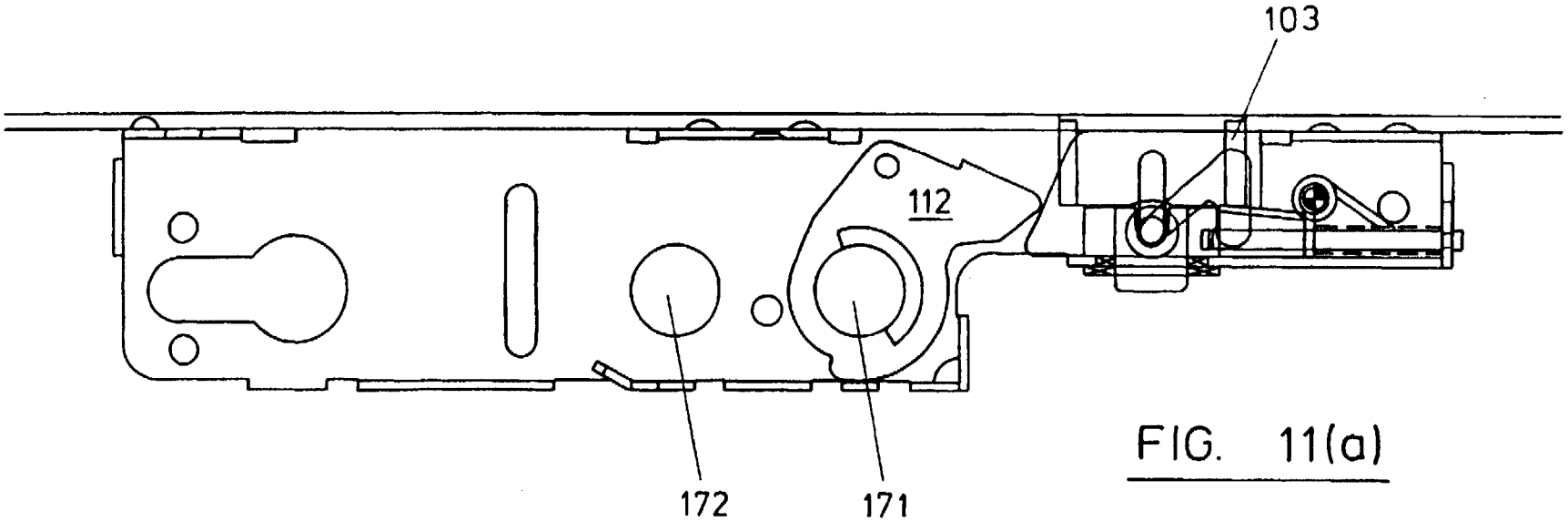

FIGS. 11A and 11B generally correspond, respectively, with FIGS. 12 and 13, but omit some of the internal components of the lock, and particularly latch link 131 for clarity.

The lock assembly shown in FIGS. 10 to 19 will usually be provided with a two spindle assembly (spindles 171 and 172), even though certain customers may prefer to have an arrangement in which both the outside handle and also the inside handle are mounted on the same spindle, and to have the facility for unlatching the lock from externally, by operation of the outer handle. In such event, internal and external handles would be mounted on top spindle 171, and lower spindle 172, (which would now be redundant), would be blanked off. This may be acceptable, and indeed required by some customers, although clearly it is a less secure arrangement, in that it will rely solely upon the deadbolts to prevent unauthorised intrusion.

Figure 10:
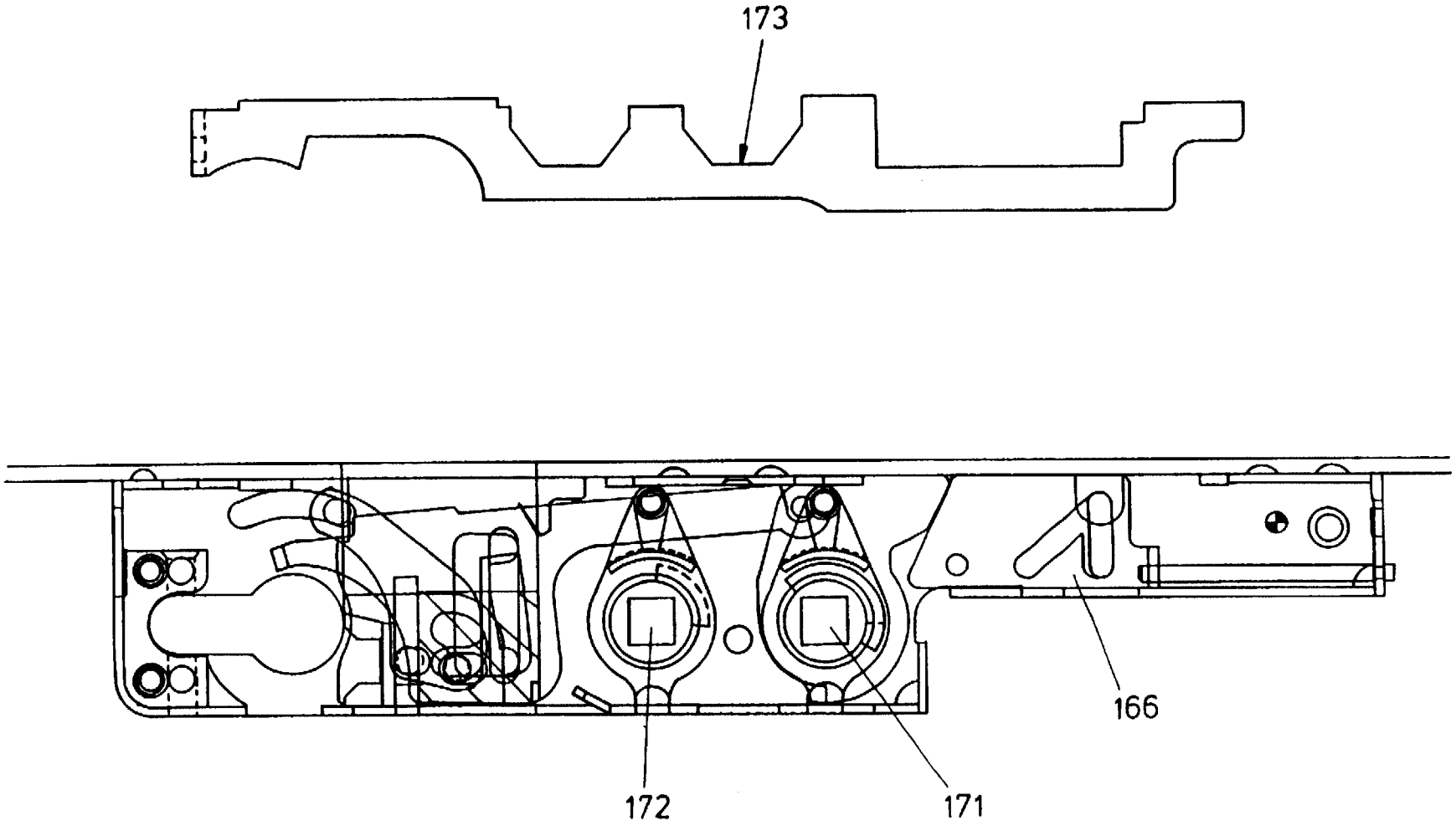
FIG. 10 is an exploded view of a second embodiment of mortise lock according to the invention.

Referring now to FIG. 10, there will now be described, in particular, the means by which top and bottom deadbolts can be operated, in addition to central deadbolt 141. Evidently, with all of the deadbolts operated, there is a very secure locking system provided, with three separate deadbolts projecting, in the locked positions, substantial distance outwardly of the closing face of the lock and into secure keepers in the fixed frame in which the door or window (provided with the lock of the invention) is mounted. This provides a very secure arrangement, to resist any forced opening of the door or window from externally e.g. by use of a jemmy or other tool.

Unlike the embodiment shown in FIGS. 1 to 9, the means by which operation of the top and bottom deadbolts takes place includes a single actuator rail, which moves in one direction only in order to operate both top and bottom deadbolts. The actuator rail is shown in exploded view in FIG. 10, and is designated generally by reference 173. Actuator rail 173 can be linearly displaced by operation of either the internal handle, or the external handle, in that both spindle 171 and spindle 172 have a driving interconnection with actuator rail 173. Actuator rail 173 can be moved to the left, as shown in FIG. 19, in order to effect locking of both the top and bottom deadbolts, whereas it moves to the right in order to unlock both deadbolts. FIG. 19 shows a cam groove and sliding peg interconnection with what will be the top deadbolt, shown by reference 174, comprising cam groove 175 and projection 176, and a generally similar, though oppositely inclined cam groove will be provided at the bottom deadbolt. FIG. 19 shows the unlocked position of the deadbolt 174 in full outline, in which peg 176 is shown at the bottom end of cam groove 175 (also shown in full lines), whereas the dotted outline of cam groove 175 illustrates the locked position of the actuator, and in which the deadbolt projection now occupies the opposite end of the cam groove 175, and is shown by reference 176'.

FIGS. **16*a* and 16*b* show, respectively, spindle actuator arms 171A and 172A respectively and they can be moved between the actuating and non actuating positions of the top and bottom deadbolts through angles of about 40°. The upward pivoting may be limited by a screw post; and coil springs 177** provide a biasing means to restore each handle to the horizontal position upon release of the handles after actuation of the top and bottom deadbolts.

Figure 15:
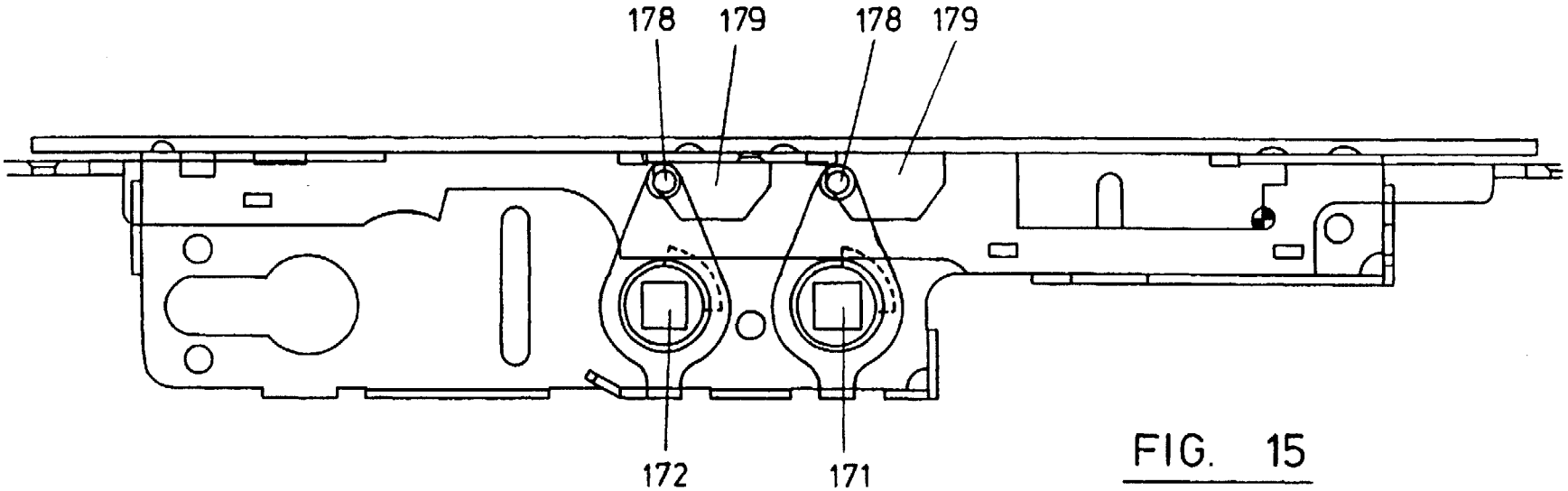
FIG. 15 is a view, similar to FIG. 14, showing the positions taken up by the lock components in the unlocked position of the top and bottom deadbolts.
Figure 14:
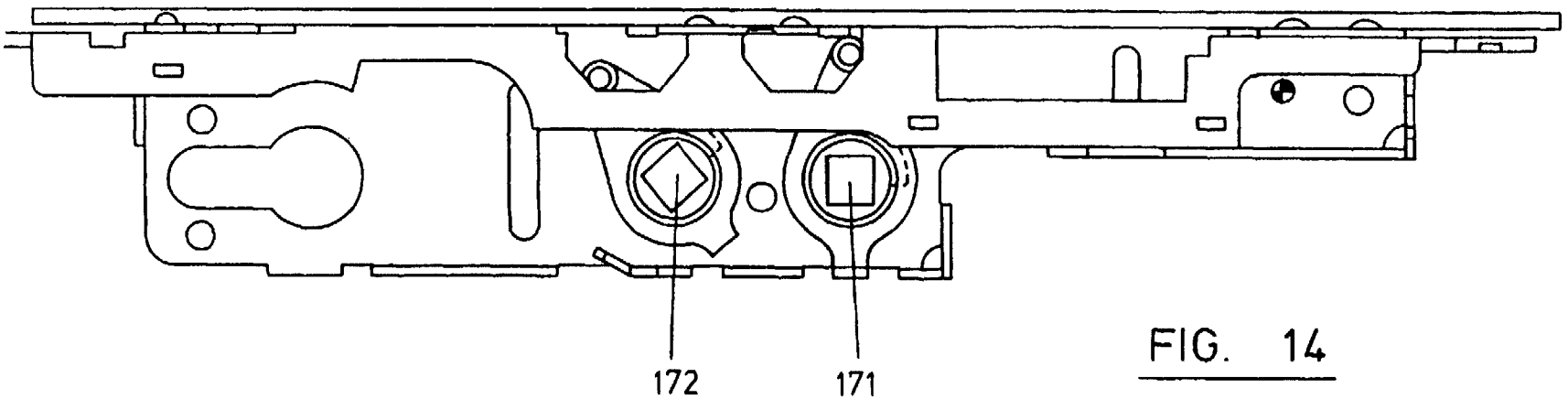
FIG. 14 illustrates some of the operating components of the lock in the positions taken up to maintain top and bottom deadbolts in the locked position.

FIG. 10 shows the actuator rail 173 in exploded view relative to the housing in which it is mounted, whereas FIGS. 14 and 15 show actuator rail 173 in its assembled position. It also shows that the actuator arms 171A and 172A have sliding cam type of coupling with the actuator rail 173, as can be seen via interconnection between rollers 178 mounted on the ends of the arms 171A and 172A, and sliding along guide surfaces of cut-outs 179 in the actuator rail 173.

The co-operation between the various internal components of the lock are such that locking and unlocking of the central deadbolt, and the top and bottom deadbolts, can only take place in a predetermined sequence of actions, and any departure from the predetermined sequence is blocked, so that the key cannot be withdrawn until completion of the locking or unlocking process has taken place in the required order.

It will always be desirable, for at least partial locking, to enable independent operation of the central deadbolt 141, and therefore the internal components of the lock are designed so that deadbolt 141 can be moved to the locked position, and the unlocked position, entirely independently of any possible operation of the other components. However, if operation of the top and bottom deadbolts is also required in addition, the design of the operating components, and particularly the shaping of the actuator rail 173, is such that locking, and unlocking of the top and bottom deadbolts can only take place in the required sequence of operations. Therefore, for a locking operation, it is necessary first to lock the top and bottom deadbolts, and this can be obtained by operation of external handle acting on spindle 172, and through actuator arm 172A, roller 178 and the respective cut out in actuator rail 173, to move the rail to the left, as shown in FIG. 14; or by operation of the internal handle acting on spindle 171, actuator arm 171A, roller 178 and the respective cut out (not shown). This will take place by upward movement of the respective handle, which moves the actuator rail 173, and then upon release of the handle, the respective spring 177 returns the handle to the horizontal position, but without causing any displacement of the actuator rail, as this movement is permitted by the space available in the respective cut out 179. After locking of the top and bottom deadbolts has taken place, locking of the central deadbolt is completed, and this is permitted by the shape of the actuator rail 173, but once the full locking movement of the central deadbolt 141 has been completed, and the key has been removed from the cylinder lock, the actuator rail 173 is incapable of being moved in a release direction (for the top and bottom deadbolts) under operation of either handle, because such movement of the actuator rail is blocked.

Conversely, during an unlocking sequence (assuming the central deadbolt and the top and bottom deadbolts are all locked), the cylinder lock must first be partly unlocked to start the withdrawal of the central deadbolt, to an extent sufficient to free the actuator rail 173, and this then allows either the internal or external handle to be operated in a downward direction, to move the actuator rail to the unlocked position (see FIG. 19), and which is followed by return movement of the handle upon release to the horizontal position, and the completion of the unlocking operation then comprises complete unlocking of the central deadbolt, followed by removal of the key, at least in the case of external operation.

A somewhat similar situation applies with regard to key operated unlatching of latch head 103, in that latch link 131 takes up a position (not shown) in which its front face is closely alongside the front face of the housing when the lock is fully actuated to the locked condition, and latch link only moves to the pivoted position shown in full lines in FIG. 10 after a complete unlocking of the central deadbolt, whereby further rotation of the cylinder lock and its cam then applies linear motion to the latch link 131, via its projecting end 155, which then causes unlatching via hooked end 162 as described above.

Referring finally to FIGS. 20 to 25 of the drawings, a mortise lock according to a further embodiment of the invention comprises a casing 201 to one side of which is secured a fore plate 202. A latch bolt assembly comprising a bevelled bolt head 203 and a bolt lathe 204 is reciprocally mounted in the casing, the lathe carrying a projecting pin 205 which extends laterally from the side of the lathe and which engages in a slot 206 in a latch bolt secondary link 207. The link 207 has a bore 208 by means of which the link is pivotally mounted on a pin 218 which is secured to the casing 201. The link 207 further carries a pin 209, which extends through an elongated horizontal slot 213 provided in a latch bolt primary link 212, and a shaped projection 210 which is engaged by one end of a coil spring 211. The other end of the spring 211 is arranged to bear against an end of the casing and is located on a dimple (not shown) formed in the casing wall. The coil spring 211 is effective to act on the secondary link 207 to urge the bolt head 203 to the position shown in FIG. 201 of the drawings in which said bolt head projects through a slot in the plate 202 to be maintained normally proud of said plate 202. The primary link 212 has a second elongated slot 214 which is substantially vertical and which is fitted over the pin 218. The slots 213 and 214 are located adjacent one end of the primary link 212 and said link carries a pin 216 at its other end, which end has a lateral extension 217. The link 212 is cranked at 215 intermediate its ends so that the lower end of the link is off-set with respect to the upper end.

A substantially vertical connecting link 221 is provided at its upper end with a vertical elongated slot 222 which is also engaged over the pin 218 on the casing 201. The link 221 is further provided in its central region with a pair of shaped slots 223 and 224 and with a pin 225 located between the slots 223 and 224. A cylinder-to-latch bolt link 226 has a bore 227 at one end by means of which the link 226 is pivotally mounted on the pin 216 on the primary link 212. The link 226 also has an inclined slot 228 for receiving the pin 225 on the connecting link 221 and is provided, at its lower end, with a flange 229. A pair of followers 231, 232 are pivotally mounted in the casing 201, each follower having a respective square-sectioned bore 233, 234 for the reception of the square-sectioned shaft of a respective door handle (not shown). Each follower 31, 32 further has a pair of arms extending from each side of the central section formed with the bores 233, 234, one arm 235, 236 carrying a pin 237, 238 extending from one side. The pins 237, 238 are located, respectively, in the shaped slots 223, 224 in the connecting link 221. The arms 235 of the upper follower 231 carries a roller 239 extending from its other side opposite the pin 237 but such a roller is omitted from the other side of the arm 236. The followers 231, 232 each have a further arm 241, 242 extending respectively in the opposite direction to the arms 235, 236 and each arm 241, 242 carries at its end a respective pin 243, 244. As shown in FIG. 20, each pin 243, 244 is engaged at each side by a spring guide 245. A first coil spring 246 bears at one end against one of the spring guides 245 engaging the pin 243 and at its other end against a further spring guide 245 which is mounted on or secured to the casing 201. A second coil spring 247 bears at one end against the other of the spring guides 245 engaging the pin 243 and at its other end on one of the spring guides 245 engaging the pin 244. A third coil spring 248 bears at one end against the other of the spring guides 245 engaging the pin 244 and at its other end on another spring guide 245 which is secured to or mounted on the casing 1.

A first handle (not shown) is mounted on a square-sectioned shaft extending into the bore 233 of the upper follower 231 only on the side of a door which is intended to be situated on the inside of a property for which the door is intended. A second handle (likewise not shown) is mounted on a second square sectioned shaft extending into the bore 234 of the lower follower 232 only on the other side of the door which will be located on the outside of the property for which the door is intended. The purpose of this will become apparent hereinafter.

In the unlocked condition of the lock, the bolt head 203 can be drawn back into the casing 201 to enable the door to be opened only by turning the handle which is fitted on the shaft extending into the follower 231 on the inside of the door. Turning this handle, i.e. by moving it in a downwards direction, has the effect of rotating the follower 231 in a clockwise direction as viewed in the drawings and the roller 239 on the arm 235 engages the lower end of the latch bolt primary link 212 and causes the latter to move upwards. This upwards movement of the link 212 carries with it the link 226, by virtue of the engagement of the pin 216 on the link 212 in the bore 227 in the link 226. The link 226 is free to move upwards with respect to the link 221 by virtue of the slot 228 in said link which engages on the pin 225. The latch bolt primary link 212 is free to move upwards in the casing 201 by virtue of the vertical slot 214 which is engaged by the pin 218 on the casing 201 and upwards movement of the link 212 causes the latch bolt secondary link 207 to pivot about the axis of the pin 218, against the action of the spring 211, by virtue of the engagement of the pin 209 on the secondary link 207 in the slot 213 in the primary link 212. Pivoting of the secondary link 207 causes the latch bolt head 203 to be retracted by virtue of the engagement of the pin 205 on the bolt lathe 204 in the slot 206 in the secondary link 207. Once the bolt head 203 has been retracted to a position in which its outer end is flush with the fore plate 202, the door can be opened. If the handle is now released, the action of the spring 247 on the follower 241 will ensure that the handle and the follower 231 are returned to the normal, usually horizontal, position. The spring 211 can now re exert itself and cause the secondary link to pivot back to its former position whereby the bolt head 203 again protrudes from the fore plate 202. At the same time, the primary link 212 and the link 226 are moved down and returned to the position shown in FIG. 20 of the drawings.

It is important to note that the latch bolt cannot be released by the handle on the outside of the door which is mounted on a shaft engaged in the lower follower 232.

The lock according to the invention includes a deadbolt assembly comprising a deadbolt 251 which is adapted, in its thrown position, to project through a slot in the fore plate 202 as shown in FIG. 20 of the drawings and, in its withdrawn position, to be located within the casing 201 with its outer end substantially flush with the outer surface of the fore plate 202.

The deadbolt 251 has a pin 252 projecting from one face which is engageable in a first elongated slot 271 in the casing 201. The deadbolt 251 also has a slot 253 extending inwardly from its rear face which is engageable on a pin 255 extending from one face of a primary link 254. The primary link consists of a shaped plate which is located to one side of the dead bolt 251 and which carries a single pin 256 and a pair of pins 257 extending from the plate on the opposite side from that of the pin 255. The link 254 also has a cut out 258 for engagement by the cam 262 of a cylinder 261. The casing 201 carries a pin 263 on which a secondary link 264 is pivotally mounted, the link being provided with a round bore 265 for this purpose. The secondary link 264 also has an elongated slot 266 which, in the assembled condition of the lock, is located over the pin 256 on the primary link 254 and the pin 252 on the deadbolt 251. As shown in FIGS. 23 and 24, the pin 252 is located at a greater distance from the fixed pivot pin 263 than the pin 256. The pin 256 extends only to engage in the slot 266 in the secondary link 264 but the pin 252 extends through the slot 266 to engage in the slot 271 in the casing 201 and serves both to connect the bolt to the driving mechanism and to guide the motion of the bolt. The pins 257 engage in a slot 272 in the casing, which slot is adjacent to and extends parallel to the slot 271 but is somewhat longer, and the engagement of the pins 257 in the slot 271 serves to guide the movement of the primary link 254 in the casing.

A detainer 274 having a shaped slot 275 with upwardly extending lateral extensions 276, 277 at each end is located to the side of the dead bolt 251 on the opposite side from the primary link 254. The pin 255 is located in the slot 275. On its side remote from the deadbolt 251, the detainer 274 has a pair of pegs 278 which engage in vertical slots 82 provided in a cover plate 281 for the casing. The cover plate also has a horizontal slot 283 into which the pin 255 extends. A flange 279 extends laterally from the upper edge of the detainer 274 and is engaged by one end of a coil spring 269 which passes through the lowermost spring guide 245 and soil spring 248 and engages at its other end on the next spring guide 245 as shown in FIG. 20. The spring 269 ensures that, when the detainer is in either of its end positions, the pin 255 will engage in either one of the lateral extensions 276, 277 of the slot 275 thereby immobilising the primary link 254 and thereby the deadbolt 251. In the unlocked position of the deadbolt assembly, the pin 255 engages in the extension 277 while in the locked position, the pin 255 engages in the extension 276.

The cylinder 261 is located in a key hole slot 267 provided in the casing 201 and in a similar key hole slot 284 in the cover plate 271 and the cam 262 can be turned when a key (not shown) is inserted into the cylinder 261 and turned. The cam 262 is engageable in the cut out slot 258 in the primary link 254 and is also arranged to bear against the flange 229 at the lowermost end of the link 226 as well as the lower edge of the detainer 274. As stated above, the maximum bolt projection that can normally be obtained by direct drive from a cylinder cam is of the order of 14 mm. The projection is limited by the dimensional relationship between the radius of the cylinder housing and the radius of the operating arm or cam. In angular terms, this represents between about 40° and 50° rotation in total. The mechanism according to the invention as above described depends on effectively extending the radius at which the motion is transmitted so that for 50° rotation a longer chord is generated, in the ratio of between 12 and 14 to 20.

The lock according to the invention further includes an additional bolting mechanism comprising a pair of slide bolt shoot rods 285 and 286. The upper rod 285 projects through a slot in the upper wall of the casing 201 and the lower rod 286 projects through a slot in the lower wall of the casing 201 as shown in FIG. 20 of the drawings. The slide bolt shoot rods 285 and 286 are effective to operate additional bolts along the leading edge or top and bottom edges of a door fitted with the lock according to the invention.

The slide bolt shoot rods 285 and 286 are connected to the connecting link 221 which is arranged to be operated by the pins 237, 238 on the follower arms 235, 236 of the followers 231, 232. If either follower is turned by its respective handle in an anti clockwise direction as viewed in the drawings, the associated follower arm 235, 236 is moved in a downwards direction. The associated pin 237, 238 on the respective follower arm 235, 236 will move down the respective shaped slot 223, 224 to the bottom thereof and will then be effective to move the connecting link 221 in a downwards direction. This downwards movement of the connecting link 221 can be transmitted directly to the lower shoot rod 286 and by a suitable lever linkage (not shown) to the upper shoot rod 285 to cause the shoot rods to operate the additional bolts referred to above. At the same time, the pin 225 on the connecting link 221 will move down the slot 228 in the link 226 causing the latter to pivot about the pin 216 and moving the flange 229 at the lower end of the lever 226 out of the path of the cam 262. Once the handle is released, the spring 246 or 247 will act on the pin 243 or 244 on the follower arm 241 or 242 to return the handle to its normal usually horizontal position.

In order to move the deadbolt 251 from the unlocked position shown in FIG. 23 of the drawings to the locked or thrown position shown in FIGS. 20 and 24 of the drawings, the connecting link 221 must first be moved down by either of the door handles so that the slide bolts are engaged and a V shaped slot 230 in the rear side of the connecting link 221 is located in the path of the secondary link 264. A key can then be inserted into the cylinder 261 and turned to rotate the cam 262 in an anti clockwise direction as viewed in the drawings. The cam is first effective to engage the detainer 274 to lift the same against the action of the spring 269 so that the lateral extension 277 is raised clear of the pin 255 and the pin is free to travel along the slot 275. The cam 262 then enters the cut out 258 in the primary link 254 and is effective to move the link. By virtue of the engagement of the pins 255 and 257 in the slots 283 and 272 respectively in the casing and the casing cover 281, the primary link 254 can only move in a longitudinal direction towards the fore plate 202. This longitudinal movement of the link 254 is transferred via the pin 256 to the secondary link 264 which in turn moves the deadbolt 251 by virtue of the engagement of the pin 252 in the slot 266. While the primary link 254 can be driven directly by the cam by a distance of only 14 mm, further longitudinal movement of the deadbolt 251 is achieved by means of the secondary link 264. The pin 252 on the deadbolt 251 is located in the slot 266 in the secondary link 264 by a greater distance from the pivot point of the secondary link than the pin 256 on the primary link 254 which is located in the same slot 266 so that 40°–50 ° rotation of the cam 262 results in a chordal distance of 20 mm of movement for the pin 252 and hence of the deadbolt 251 hence giving a deadbolt throw of 20 mm.

The lower edge of the detainer 274 is provided with a curved depression 273 to permit the cam 262 of the cylinder 261 to be turned without interference from the detainer once the detainer has been raised to its appropriate level. Once the rotation of the cam 262 has carried it round past the detainer, the spring 269 can re assert itself. The pin 255 on the primary link 254 has by this time been moved to the left hand end of the slot 275 as viewed in the drawings and is located opposite the lateral extension 276. The spring 269 is effective to move the detainer back down to its former position so that the pin 255 is now engaged in the lateral extension 276 of the slot 275 thereby to immobilise the primary link 254 and hence the deadbolt 251.

As the secondary link 264 is moved by the primary link 254 to move the deadbolt 251 into the thrown or locked position, it engages in the V shaped slot 230 in the connecting link 221 which has the effect of trapping said link at its lowest position of travel. The engagement of the pin 225 on the link 221 in the slot 228 in the link 226 prevents the link 226 from being moved in an upwards direction which in turn prevents any movement of the latch bolt assembly which is thus also locked in the thrown position to give the lock additional security. At the same time the handles on the shafts extending into the followers 231 and 232 are immobilised since the connecting link 221 is immobilised by the secondary link 264 and the slide bolts are thus secured in the thrown position.

The deadbolt can only be moved to its unlocked position by inserting a key into the cylinder 261 and turning the cam 262 in the opposite direction, i.e. clockwise as viewed in the drawings. As before, the cam 262 first engages the lower edge of the detainer 274 to lift the same, against the action of the spring 269, so that the lateral extension 276 is raised clear of the pin 255. The cam 262 travels along the curved depression 273 of the detainer 274 moving in the cut out 258 until its engages the primary link 254. The link 254 is then moved backwards by the cam 262 and as the pin 255 travels along the slot 275 in the detainer 274, the secondary link 264 pivots about the pin 263 on the casing and retracts the deadbolt 251 again by the same greater distance than the lateral movement of the primary link 274. At the end of the lateral movement of the primary link 254 when the cam 262 has moved clear of it, the pin 255 is again located opposite the lateral extension 277, the cam is moved clear of the detainer 274 and the detainer is again moved downwards by the spring 269 so that the pin 255 is engaged in the lateral extension 277 of the slot 275 and the primary link 254 and hence the dead bolt 251 are again immobilised.

In order to free the latch bolt, it is now necessary to move the connecting link 221 upwards by turning either of the handles so that the followers 231 or 232 move in a clockwise direction as viewed in the drawings. The engagement of the associated pins 237, 238 in the respective slots 223, 224, causes the connecting link 221 to move upwards to retract the slide bolts. At the same time, as the pin 235 on the link 221 moves up the slot 228 in the link 226 is causes said link to pivot about the pin 216 to move the flange 229 at the lower end of the link 226 into the path of the cam 262. In order to open a door fitted with the lock from the outside, it is now necessary to rotate the cam further in a clockwise direction as viewed in the drawings until it engages under the flange 229 and is effective to lift the flange and hence the link 226. This upward movement of the link will in turn cause the primary latch bolt link 212 to move upwards by virtue of the engagement of the pin 216 in the bore 227 and the upward movement of the primary link 212 will cause the latch bolt secondary link 207 to pivot about the pin 218 to retract the latch bolt head 203 as above described. Thus, turning of the key will not only unlock the deadbolt but will also retract the latch bolt enabling the door to be opened. The key can then be turned back for removal from the cylinder so that the cam 262 is moved clear of the flange 229. The spring 211 will then be effective to cause the secondary link 207 to pivot to move the latch bolt 203 back to the latched position and to return the links 212 and 228 to the lowered positions.

The door can be opened from the inside either by turning the key as above described or by turning the handle on the shaft engaging in the upper follower 231. The door can only be opened from the outside with the use of a key. Moveover, when the door has been locked with the dead lock in the manner above described, it cannot be opened without the use of a key from either the inside or the outside because the connecting link 221 has been immobilised by the engagement of the secondary link 264 in the slot 230 and the upper follower 231 cannot be turned to engage the latch bolt primary link 212 because of the engagement of the pin 237 on the follower arm 235 in the upper end of the slot 223 as shown in FIG. 20 of the drawings.

In order to secure the cover plate 281 to the casing 201, the latter is provided with a pair of upstanding pegs 287, 288 which are provided with screw threaded bores and the cover plate 210 is provided with aligned holes (not shown) by means of which the cover plate can be secured to the casing by screws (not shown) which engage through the holes in the cover plate and mate with the screw threaded bores in the pegs 287 and 288. The cover plate 210 is further provided with a slot for receiving the pin 205 on the latch bolt lathe 204 which assists in ensuring that the cover plate is correctly registered with the casing and which serves to guide the latch bolt lathe 204. Both the cover plate 281 and the casing 201 are also provided with round apertures 291, 292 for receiving and locating the followers 231 and 232 respectively. Finally, the cover plate may further be provided with recesses around its periphery which are designed to engage with corresponding ribs on the edges of the casing walls (not shown) again to ensure correct registry of the cover plate with the casing.

Although as stated in the foregoing, the lock according to the invention is primarily intended for use with narrow style doors made of UPVC or similar materials, it will be appreciated that the lock is not restricted to use with such doors but is suitable for use with any door including solid wooden doors or steel or aluminium doors.

Further, the invention is not restricted to the above described and illustrated embodiments but variations and modifications may be made without departing from the scope of the invention. For example, although the invention has been particularly described for use with cylinder locks, it is also applicable to lever locks as will be apparent to those skilled in the art.

We claim:

1. A lock having a dead lock assembly in a casing, said dead lock assembly comprising a dead bolt, said bolt being moveable in a longitudinal direction to a thrown or locking position; and a drive mechanism, said drive mechanism being adapted to be manually operated, wherein the drive mechanism comprises a lever, said lever being actuated by a key and said lever driving a driving link, said driving link being arranged in turn to drive said bolt, said driving link being provided with guide means, said guide means ensuring that said driving link moves only in said longitudinal direction substantially parallel to the movement of said bolt; and transferring means, said transferring means transferring the drive from said driving link to said bolt, said transferring means being pivotally mounted relative to said driving link and said transferring means being provided with guide means for guiding said transferring means pivotal movement in said casing, said transferring means and said bolt having a peg and slot engagement with one another, such that said movement or throw of said bolt is increased relative to the displacement of said driving link, said pivotal mounting for said transferring means is on said driving link.

2. A lock according to claim 1 in which said transferring means comprises a quadrant, said quadrant having a peg, said peg engaging through a slot in said driving link and into a slot in said bolt.

3. A lock according to claim 1, in which said driving link is sandwiched between said bolt and said transferring means.

4. A lock according to claim 1, including a detainer and engagement means providing an engagement between said detainer and said bolt, said detainer being spring loaded, said spring urging said engagement means to a position in which said engagement means are effective to immobilize said bolt in said thrown or locking position.

5. A lock according to claim 4, in which said engagement means comprises a detainer pin on said bolt, said detainer pin being engageable in a slot in said detainer, said slot having such a configuration that said pin is retained in a fixed position in said slot by said spring when said bolt is in the thrown or locked position.

6. A lock according to claim 1, including a cylinder, a spring and a detainer, said cylinder having a cam arranged to be turned by a key, said cam being engageable with said detainer to move said detainer, against the action of said spring, to a position in which said detainer pin on said bolt is free to move in said slot in said detainer.

7. A lock according to claim 1, including a casing accommodating said dead bolt assembly and a pair of additional dead bolts, said additional dead bolts being slidably mounted in said casing, said pair of additional dead bolts being arranged to be operated simultaneously by drive means and said drive means being arranged to be immobilized when said dead bolt of said first dead bolt assembly is in said thrown or locked position.

8. A lock according to claim 7, in which said drive means for said additional dead bolts is arranged to prevent said dead bolt of said first mentioned dead bolt assembly from being moved from a withdrawn position to said thrown position unless said drive means has been operated to move said additional dead bolts to said thrown or locked position.

9. A lock according to claim 1, including a latch mechanism, said latch mechanism being adapted to be operated by one or more door handles.

10. A lock according to claim 7, said lock providing a latch mechanism and having two drive shafts, said first one of said drive shafts being adapted to be fitted with a first handle on one side of a door and said second of said drive shafts being adapted to be fitted with a second handle on the other side of said door, said first handle being arranged to operate both said drive means for said additional dead bolts as well as said latch mechanism and said second handle being arranged to operate only said drive means for said additional dead bolts.

11. A lock according to claim 10, including a linkage whereby said latch mechanism can be operated by means of a key engaging in said lock from the outside of said door in order that said door can be open.

12. A lock according to claim 10, in which said two drive shafts are provided with intermeshing pinions whereby movement of one of said drive shafts to lock or unlock said additional dead bolts is transferred to said other drive shaft, means being provided to permit said first drive shaft to be turned to operate said latch mechanism without said turning movement being transmitted to said second drive shaft.

13. A lock for a door or the like having a dead bolt assembly in a casing, said dead bolt assembly comprising a bolt and a drive mechanism adapted to be manually operated, wherein the drive mechanism comprises a lever manually driven, said lever driving a driving link, said driving link driving transferring means, said transferring means being operatively connected to said bolt, in which said transferring means is pivotally mounted on said driving link and said transferring means is provided with at least one elongated slot, and an aperture, said driving link having a first projection and said bolt having a second projection, said first projection engaging said aperture and said second projection engaging in said elongated slot, said first projection being located closer to said pivotal mounting of said driving link than said second projection.

14. A lock according to claim 13, in which said drive mechanism is manually operable either by a handle or by a key.

15. A lock according to claim 13, in which said transferring means is provided with two elongated slots, each of said first and said second projections being located in a respective one of said slots.

16. A lock according to claim 13, in which said transferring means is pivotally mounted at or adjacent to one end, whereby movement of said driving link and said bolt will be in the same direction.

17. A lock according to claim 15, in which said transferring means is pivotally mounted between said two projections, movement of said driving link in one direction causing said bolt to be moved by said transferring means in the other opposite direction.

18. A lock according to claim 13, in which said driving link is provided with guide means, said guide means ensuring that said link moves only in a longitudinal direction substantially parallel to the movements of said bolt.

19. A lock according to claim 13, including a detainer and engagement means for providing an engagement between said detainer and said bolt, said detainer being spring loaded, said spring urging said engagement means to a position in which said engagement means are effective to immobilize said bolt in its thrown or locking position.

20. A lock according to claim 19 in which said engagement means comprises a detaining pin on said driving link, said detainer pin being engageable in a slot in said detainer, said slot having such a configuration that said pin is retained in a fixed position in said slot by said spring when said bolt is in said thrown or locked position.

21. A lock according to claim 13, including a cylinder said cylinder having a cam arranged to be turned by a key, said cam being engageable with said detainer to move said detainer, against the action of said spring, to a position in which said detainer pin on said driving link is free to move in said slot in said detainer and said cam also being arranged to move said driving link on being moved by a key in said cylinder.

22. A lock according to claim 13, said lock being provided with additional dead bolts and drive means therefore and with a latch mechanism and drive means therefore, and provided with two drive shafts, a first one of said drive shafts being adapted to be fitted with a first handle on one side of a door and said second of said drive shafts being adapted to be fitted with a second handle on another side of said door, said first handle being arranged to operate both drive means for additional dead bolts as well as a latch mechanism and said second handle being arranged to operate only said drive means for said additional dead bolts.

23. A lock according to claim 13, provided with a latch mechanism, including a linkage whereby said latch mechanism is operable by means of a key engaging in said lock from said outside of said door in order that said door can be opened.

* * * * *